US010760273B1

(12) United States Patent
Alexander

(10) Patent No.: US 10,760,273 B1
(45) Date of Patent: Sep. 1, 2020

(54) APPARATUS AND METHODS FOR PROVIDING CONTINUOUS STRUCTURAL SUPPORT TO FOOTINGS AND INTERCONNECTED HOLLOW CORE WALL UNITS

(71) Applicant: Alexander Innovations, LLC, Chapel Hill, NC (US)

(72) Inventor: W. Joseph Alexander, Chapel Hill, NC (US)

(73) Assignee: Alexander Innovations, LLC, Chapel Hill, NC (US)

( * ) Notice: Subject to any disclaimer, the term of this patent is extended or adjusted under 35 U.S.C. 154(b) by 0 days.

(21) Appl. No.: 16/250,644

(22) Filed: Jan. 17, 2019

Related U.S. Application Data

(60) Provisional application No. 62/618,285, filed on Jan. 17, 2018.

(51) Int. Cl.

| | |
|---|---|
| ***E04C 5/16*** | (2006.01) |
| ***E04B 1/41*** | (2006.01) |
| ***E04B 2/20*** | (2006.01) |
| ***E04C 5/20*** | (2006.01) |
| *E04B 2/02* | (2006.01) |

(52) U.S. Cl.
CPC ..... *E04C 5/166* (2013.01); *E04B 1/41* (2013.01); *E04B 2/20* (2013.01); *E04C 5/201* (2013.01); *E04B 2001/4192* (2013.01); *E04B 2002/0243* (2013.01); *E04B 2002/0254* (2013.01)

(58) Field of Classification Search
CPC ..... E04B 1/41; E04B 2001/4192; E04B 2/20; E04B 2/8647; E04B 2/8652; E04B 2002/0254; E04B 2002/0243; E04B 2001/2463; E04B 2/16; E02D 27/50; E02D 27/08; E04C 5/162; E04C 5/266; E04C 5/201; E04C 5/166; E04G 21/185
USPC ..... 52/166, 169.1, 293.2, 293.3, 295, 223.5, 52/677; 135/118
See application file for complete search history.

(56) References Cited

U.S. PATENT DOCUMENTS

| | | | | | |
|---|---|---|---|---|---|
| 567,332 | A * | 9/1896 | Burster | E02D 7/16 | 52/114 |
| 903,000 | A * | 11/1908 | Priest | E04B 1/4185 | 52/562 |
| 1,161,303 | A * | 11/1915 | Fritz | E02D 5/80 | 52/155 |
| 1,923,657 | A * | 8/1933 | Beers | B64F 1/12 | 52/166 |

(Continued)

FOREIGN PATENT DOCUMENTS

| | | | | |
|---|---|---|---|---|
| CA | 300311 A1 * | 10/2000 | ..... | E02B 7/005 |
| GB | 779440 A * | 7/1957 | ..... | E04C 5/201 |

(Continued)

*Primary Examiner* — Robert Canfield
(74) *Attorney, Agent, or Firm* — NK Patent Law

(57) ABSTRACT

A system includes apparatus and methods for providing continuous structural support to footings and hollow core wall units. In operation, wire rope chairs, connectors, wedge pins, and a tensioner tool are used to interconnect wire rope within footings and hollow core wall units laid on the footings, allowing for continuous wire rope within selected units that when grouted, provide an interconnected reinforced structural wall that is safer to install than traditional methods, with other advantages.

4 Claims, 42 Drawing Sheets

(56) References Cited

U.S. PATENT DOCUMENTS 2,350,767 A * 6/1944 Keating ..... B64F 1/12 52/166
3,968,615 A * 7/1976 Ivany ..... E04B 2/8629 52/439
4,154,554 A * 5/1979 Hilfiker ..... E02D 29/0266 405/273
4,475,843 A * 10/1984 Wyler ..... E04C 5/166 256/55
4,627,205 A * 12/1986 Hitchins ..... E04G 13/00 52/169.9
4,688,363 A * 8/1987 Sweeney ..... E04B 1/4185 52/407.4
4,817,353 A * 4/1989 Woods ..... E02D 27/00 52/295
4,831,803 A * 5/1989 Leonardis ..... B65D 5/006 52/323
4,903,450 A * 2/1990 Adams ..... E02D 27/02 52/293.2
4,976,087 A * 12/1990 Pizzino ..... E02D 27/01 52/169.1
4,998,393 A * 3/1991 Baena ..... E04B 1/161 52/236.9
5,174,083 A * 12/1992 Mussell ..... E02D 27/02 249/5
5,937,604 A * 8/1999 Bowron ..... E04G 21/185 248/229.16
6,837,017 B2 * 1/2005 Hardy, Jr. ..... E01C 11/18 404/136
7,866,114 B2 * 1/2011 De La Cruz ..... E04C 5/20 404/135
8,099,925 B1 * 1/2012 Coons ..... E04C 5/20 248/346.04
8,505,859 B2 * 8/2013 Leung ..... A01G 9/28 248/87
8,752,355 B2 6/2014 Moroschan
9,523,194 B2 * 12/2016 Clear ..... E04B 2/26
10,214,925 B2 * 2/2019 Hartman ..... E04G 21/185
10,285,341 B2 * 5/2019 McCaslin ..... B05B 15/622
10,449,699 B2 * 10/2019 Goss ..... B29C 39/10
2002/0112437 A1 * 8/2002 Queen ..... E04C 5/20 52/677
2002/0174614 A1 * 11/2002 Dilon ..... E02D 27/02 52/292
2003/0000170 A1 * 1/2003 Sorkin ..... E04C 5/20 52/677
2003/0070388 A1 * 4/2003 Catani ..... E04C 5/16 52/677
2003/0106278 A1 * 6/2003 Hupkens ..... E04B 2/20 52/562
2005/0081465 A1 4/2005 Crumley
2006/0188335 A1 * 8/2006 Harris ..... E01C 11/18 404/136
2006/0201082 A1 * 9/2006 Hammer ..... E04C 1/395 52/223.5
2007/0107333 A1 * 5/2007 Marsh ..... E04B 2/16 52/223.7
2008/0209843 A1 * 9/2008 Helms ..... E04C 5/205 52/677
2009/0013638 A1 * 1/2009 Clarno ..... E04C 1/395 52/745.09
2009/0260306 A1 * 10/2009 Ebanks ..... E02D 27/02 52/285.3
2009/0260312 A1 * 10/2009 Lee ..... E04B 2/10 52/562
2009/0313923 A1 * 12/2009 Bucheger ..... E04B 2/44 52/223.7
2010/0325998 A1 * 12/2010 Clear ..... E04B 1/4178 52/503
2014/0190116 A1 * 7/2014 Holthusen ..... E04C 5/168 52/684
2014/0331592 A1 * 11/2014 Lawrence ..... E04C 5/168 52/677
2018/0030728 A1 * 2/2018 Johnson ..... E04B 2/54

FOREIGN PATENT DOCUMENTS

JP 60159225 A * 8/1985 ..... E02D 27/01
WO WO-00/57334 A2 * 9/2000

* cited by examiner

FIG. 8A
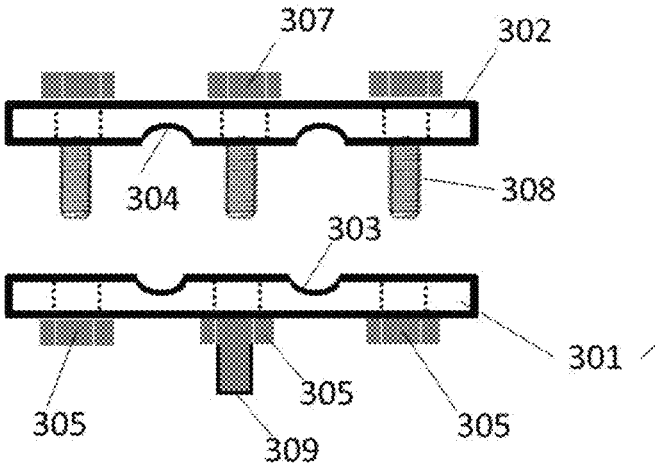
FIG. 8B
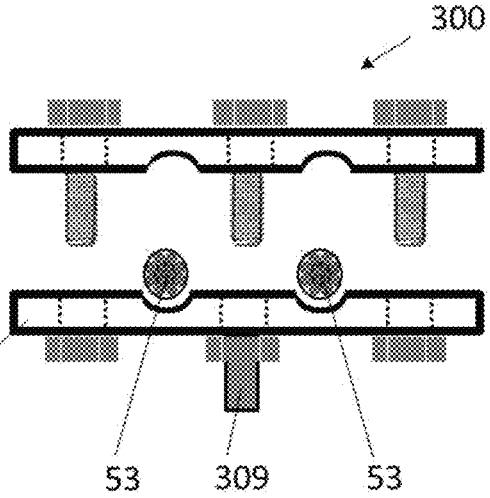
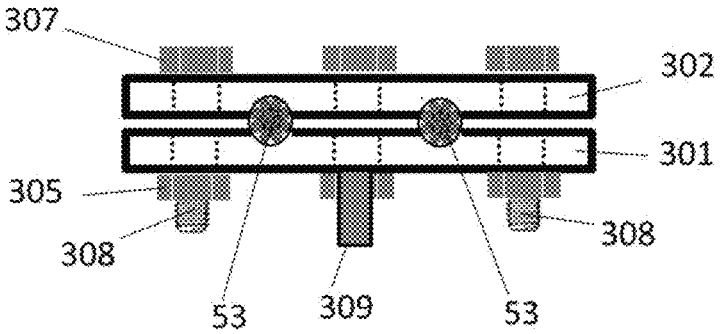
FIG. 8C

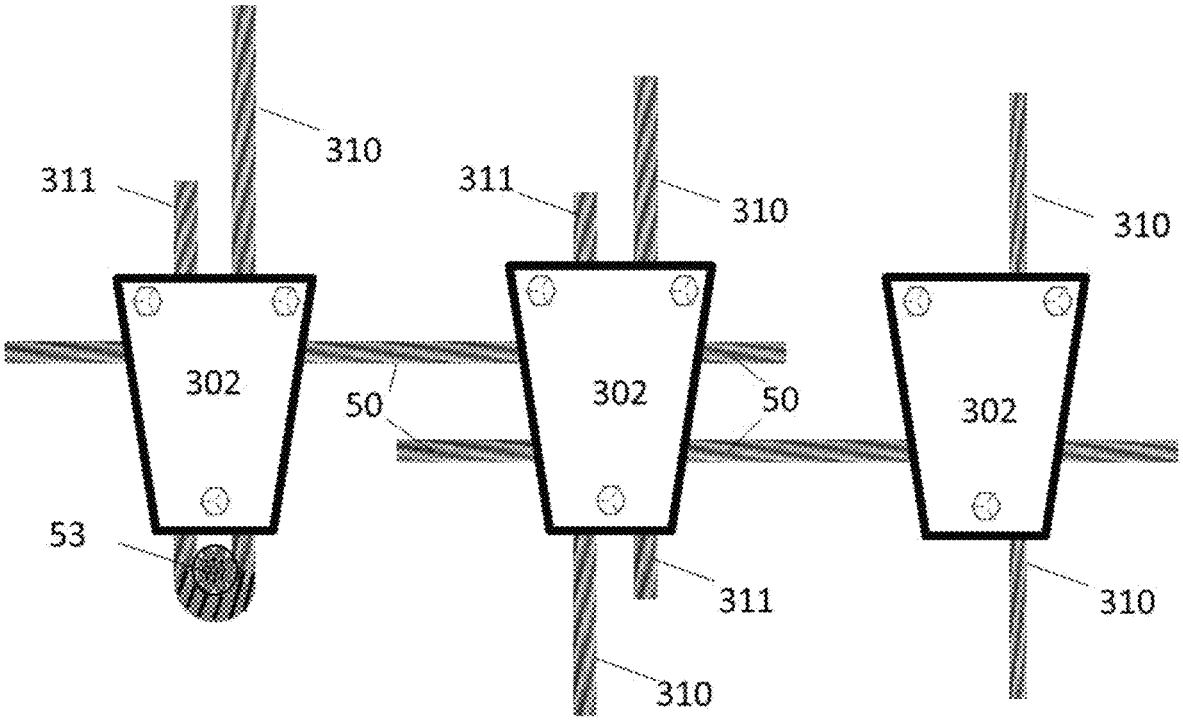
FIG. 9D
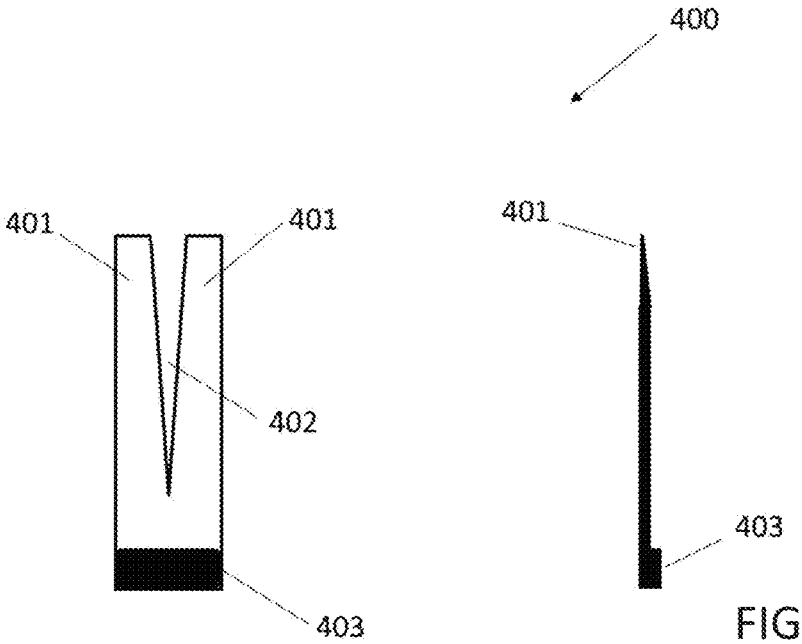
FIG. 10A
FIG. 10B

APPARATUS AND METHODS FOR PROVIDING CONTINUOUS STRUCTURAL SUPPORT TO FOOTINGS AND INTERCONNECTED HOLLOW CORE WALL UNITS

CROSS-REFERENCE TO RELATED APPLICATION

This application claims the benefit of U.S. Provisional Patent Application No. 62/618,285, filed on Jan. 17, 2018, the contents of which are incorporated by reference herein.

TECHNICAL FIELD

The present disclosure relates to structural reinforcement of hollow core wall units. More particularly, the present disclosure relates to apparatus and methods for providing continuous structural support to hollow core wall units built upon reinforced footings using wire rope and related components.

BACKGROUND

Readily available and modular concrete masonry units (CMUs) are commonly used for constructing low-rise buildings (i.e., typically less than three stories). These buildings include residential, educational, commercial, and industrial structures. The CMUs are held together with mortar thereby forming a rigid structure. Many of the CMUs have hollow cores that are used to create cavity walls, wherein steel reinforcement can be placed in the vertical and horizontal spaces to carry loads and resist other forces acting upon the walls. Structural support to walls and footings may be required by structural engineers or architects to meet local building codes. The building codes vary in different geographic regions in association with potential lateral loads to walls resulting from wind or earthquake motions from seismic activity.

Structural reinforcement of hollow core wall units typically relies on placing steel reinforcing bar (rebar) in wall units that are connected to rebar in the footing and subsequently filling the cores with grout. The current disclosure provides alternative methods and devices that have significant advantages over the use of rebar for reinforcement of walls in low-rise buildings. Specifically, apparatus and methods are used to construct a concrete footing reinforced with wire rope that is continuously connected to a wall composed of hollow core units built in courses on top of the reinforced footing, in which selected hollow cores have straightened and connected wire rope vertically within vertical cores, and selected bond beam blocks have straightened and connected wire rope horizontally within hollow cores, and the cores that contain straightened and connected wire rope are filled with grout to form a reinforced structural wall that is interconnected with the concrete footing.

Other building materials, such modular hardscape units, also have hollow cores that could benefit from the apparatus and methods presented in the current disclosure. The reference to hollow core wall units used in the context of the current disclosure is, therefore, not limited to CMUs, but any modular wall units or masonry blocks that have holes, channels, or hollow cores through which wire rope could be placed, continuously connected to a concrete footing also reinforced with wire rope using the apparatus and methods described herein, and thereby form a structural wall that is interconnected with a reinforced footing.

There are advantages of using the wire rope apparatus and methods described in the current disclosure compared to the conventional use of rebar in structural walls. A common practice is to extend rebar upward from foundations or footings and for masons to lift heavy blocks up and over the rebar. Although protective caps are made for the top of the vertically exposed rebar, only those caps that contain metal can minimize the risks of serious injury or even death from workers falling on rebar. Even though falls at construction sites are the most common form of accidents according to the Occupational Health and Safety Association (OSHA), construction workers often neglect using protective caps on rebar, or use improper caps. OSHA reports indicate that serious injuries have resulted from workers falling on rebar in addition to death by impalement. Other serious accidents occur while working with rebar, such as cutting or bending the rebar.

Worker injuries also can result from the repetitive lifting of masonry blocks, particularly for sections of walls with extended lengths of rebar and when larger CMUs are involved (e.g., a two-core cement block with nominal dimensions of 8 by 12 by 16 inches weighs about 40 pounds). The use of wire rope for structural support reduces the potential for these types of accidents since wire rope does not stand upright or protrude laterally like rebar, and the amount of block lifting is limited to the height of the current wall course that is being worked on (i.e., no lifting blocks up and over the vertically exposed rebar). Another key advantage over rebar is that wire rope does not have to be bent and is flexible enough to go around obstructions in the footing and/or wall cores, saving workers time and therefore project costs.

There are also practical reasons that masons prefer not to lift blocks up and over rebar that extends vertically above a footing, sometimes at substantial heights of 10 or 15 feet. Considerable time is required to lift the blocks up and over the vertically extended rebar, breakage of blocks is common in this process, and it is also difficult to keep mortar on the block edges during the extensive lifting process. These practical limitations are often overcome by overlapping (or splicing) two shorter segments of rebar together to create a single structural integrity. Wire tying of rebar overlap will likely be specified by the structural engineer or architect in accordance with Section 2107 of the International Building Code.

However, since building inspectors are not available to observe every reinforced hollow core, some masons are known to take short cuts to avoid the time it takes to properly overlap and tie rebar together. Rebar that is simply stuck in a core and may not be close to another section of rebar, and/or has insufficient overlap, defeats the purpose of continuous reinforcement (i.e., to resist lateral loads to a wall from wind or seismic forces that could cause a wall to be damaged or potentially fail). Unfortunately, improper installations of rebar will be hidden from inspectors once the next course of wall units is laid and the cores are grouted.

Coiled wire rope is significantly safer to work than rigid rebar in the proposed application since it can be conveniently stored in the hollow cores as additional courses are laid. Workers can simply pull the coils of wire rope upward as the wall progresses without it interfering with the masonry activities. Building inspectors and project supervisors will be in a better position to observe with only periodic checks that continuous reinforcement of the wall is provided through the use of wire rope. Apparatus in the current disclosure allow additional strands of wire rope to be joined vertically and horizontally in a straightforward and continuous manner that can also serve as convenient inspection points for building inspectors and supervisors without significant delays in the masonry activities.

The apparatus and methods in the current disclosure have applications beyond the use for structural walls and foundations described herein. For example, other construction applications include, but are not limited to, reinforcement of concrete floor slabs, structural support of retaining walls and free-standing hardscape walls, and reinforcement between footings or slabs with overlying wooden or metal frame structures. The devices described in the current disclosure also have applications beyond the use for interconnected foundations and structural walls, some of which are described herein; other uses others will become apparent to future users when the products are commercialized.

SUMMARY

This summary is provided to introduce in a simplified form concepts that are further described in the following detailed descriptions. This summary is not intended to identify key features or essential features of the claimed subject matter, nor is it to be construed as limiting the scope of the claimed subject matter.

In at least one embodiment, a wire rope chair includes a base, cross brace, and an extended arm for supporting wire rope horizontally in the excavation for a footing. In at least one example, the extended arm has a tapered trough for holding wire rope in place in the excavation for a footing.

In at least one embodiment, a wire rope chair is modified to include a vertical arm with a tapered trough for holding the wire rope in place vertically and for supporting wire rope both vertically and horizontally in an excavation for a footing.

In at least one example, a wire rope extends vertically from a chair set in a poured concrete footing and extends upward through the vertical cores of hollow core wall units constructed in courses on a footing, wherein the wire rope may be joined with other wire ropes at an elevation above the footing with a wire rope connector, which will sometimes be referred to herein as engagement elements.

In at least one embodiment, the wire rope connector has engagement elements that include parallel channels on opposing plates that can be bolted together securing multiple wire ropes in compression that may join the wire rope connector from different directions, vertically and/or horizontally.

In a least one example, when used in conjunction with hollow core wall units installed in courses above a footing, the wire rope system provides reinforcement to the wall with wire rope placed horizontally and vertically within a concrete footing that is continuous with wire rope that is placed in vertical cores and horizontally in bond beams in the hollow core wall units above the footing.

In at least one example, a tapered wire rope pin is wedged between the bottom of the wire rope connector and the top of an uppermost hollow core wall unit, thereby straightening the wire rope within the vertical cores below and holding the wire rope in position at least until the vertical cores are grouted.

In at least one example, wire rope is placed horizontally in the open channel of a bond beam block and is joined to the side of a wire rope connector and straightened and held in position using a wire rope pin at least until the horizontal hollow cores of the bond beam blocks are grouted.

In at least one embodiment, a wire rope straightener, which will sometimes be referred to herein as a tensioner tool, may alternatively be used to straighten the wire rope vertically within the vertical cores, or horizontally within the bond beam blocks, particularly in cases where the wire rope may be obstructed.

In at least one embodiment, a method includes the use of the apparatus to construct a concrete footing reinforced with wire rope that is continuously connected to a wall composed of hollow core units built in courses on top of the reinforced footing, in which selected hollow cores have straightened and connected wire rope vertically within vertical cores, and selected bond beam blocks have straightened and connected wire rope horizontally within hollow cores, and the cores that contain straightened and connected wire rope are filled with grout to form a reinforced structural wall that is tied into the concrete footing.

In at least one embodiment, a system comprising a chair for holding wire rope horizontally in a footing; a chair for holding wire rope horizontally and vertically in a footing; a wire rope connector joining wire ropes from different directions in hollow core wall units; a wire rope pin that straightens and holds the wire rope in hollow cores when grouting; a wire rope straightener that may alternatively be used to straighten wire rope in some cases; and wherein, in operation, and used in conjunction with hollow core wall units installed in courses above a footing, the system provides reinforcement to the wall between the wire rope placed horizontally and vertically within a concrete footing that is continuously connected to a wall composed of hollow core units built in courses on top of the reinforced footing, in which selected hollow cores have straightened and connected wire rope vertically within vertical cores, and selected bond beam blocks have straightened and connected wire rope horizontally within hollow cores, and the cores that contain straightened and connected wire rope are filled with grout to form a reinforced structural wall that is interconnected with the reinforced concrete footing.

BRIEF DESCRIPTION OF THE DRAWINGS

The previous summary and the following detailed descriptions are to be read in view of the drawings, which illustrate particular exemplary embodiments and features as briefly described below. The summary and detailed descriptions, however, are not limited to only those embodiments and features explicitly illustrated.

FIG. 8A is an overhead view of a wire rope connector in an open position.

FIG. 8B is an overhead view of a wire rope connector in an open position with wire ropes in the channels of the bottom plate.

FIG. 8C is an overhead view of a wire rope connector in a closed position compressing the wire ropes in the channels of the top and bottom plates.

FIG. 9D is a side elevation view of wire rope connectors used to connect multiple vertical and horizontal wire ropes together.

FIG. 10A is an overhead view of a device used to straighten and hold wire rope in place, referred to in the present disclosure as a wire rope pin, according to at least one embodiment.

FIG. 10B is a side elevation view of a wire rope pin.

DETAILED DESCRIPTIONS

Figure 1:
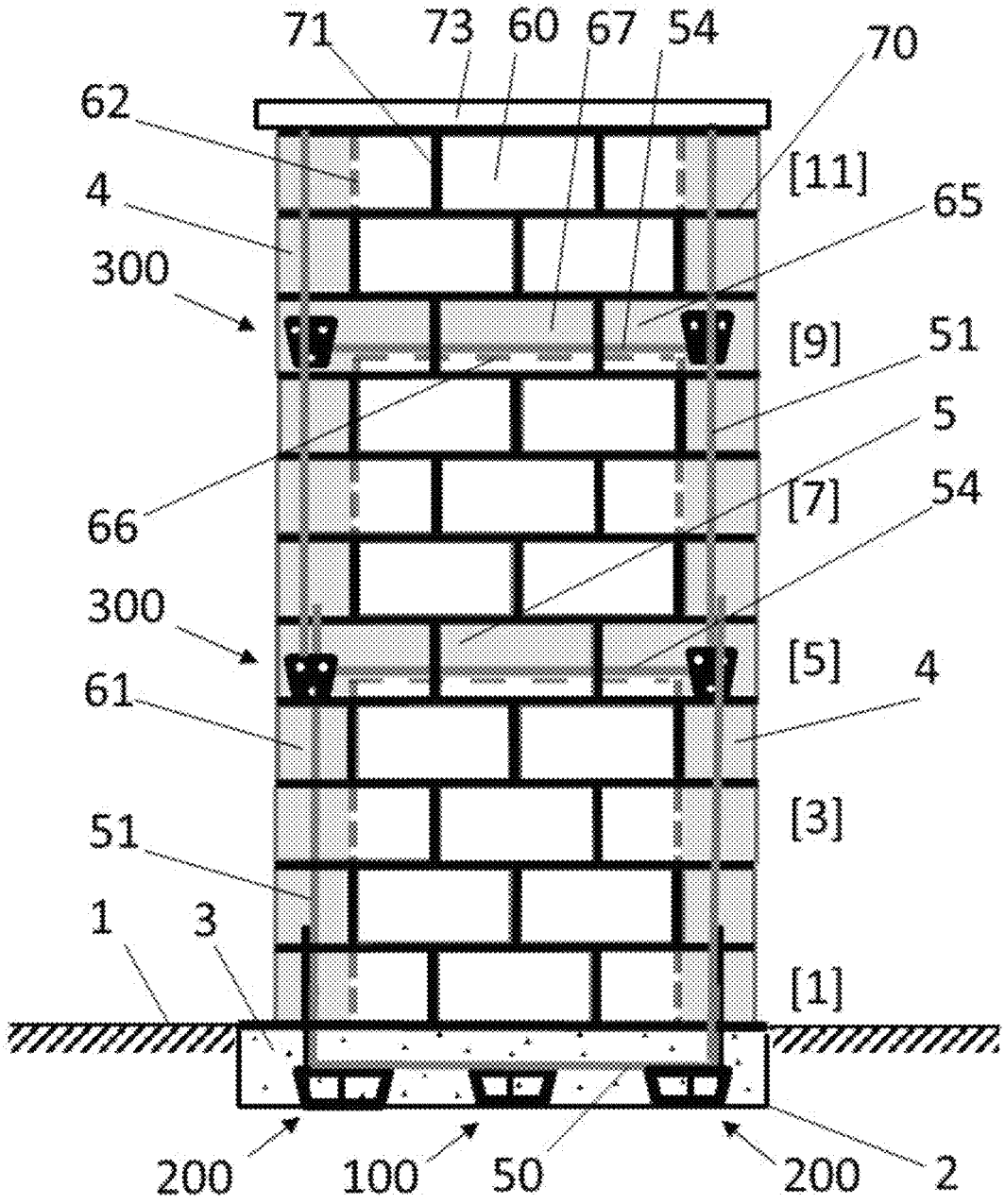
FIG. 1 is a side elevation view showing a completed wall section that has been reinforced with wire rope in the footing and within selected hollow cores of the wall units, according to at least one embodiment.

These descriptions are presented with sufficient details to provide an understanding of one or more particular embodiments of broader inventive subject matters. These descriptions expound upon and exemplify particular features of those particular embodiments without limiting the inventive subject matters to the explicitly described embodiments and features. Considerations in view of these descriptions will likely give rise to additional and similar embodiments and features without departing from the scope of the inventive subject matters. Although the term "step" may be expressly used or implied relating to features of processes or methods, no implication is made of any particular order or sequence among such expressed or implied steps unless an order or sequence is explicitly stated.

Any dimensions expressed or implied in the drawings and these descriptions are provided for exemplary purposes. Thus, not all embodiments within the scope of the drawings and these descriptions are made according to such exemplary dimensions. The drawings are not made necessarily to scale. Thus, not all embodiments within the scope of the drawings and these descriptions are made according to the apparent scale of the drawings with regard to relative dimensions in the drawings. However, for each drawing, at least one embodiment is made according to the apparent relative scale of the drawing.

FIG. 1 is a side elevation view showing a completed wall section that has been reinforced with wire rope in the footing and within the hollow cores of selected wall units using the devices and methods in the present disclosure, according to at least one embodiment. A ground surface 1 has been excavated to a specified depth 2 to form the base of a footing for a wall. A horizontal section of wire rope 50 is resting on a wire rope chair 100 in the middle of the footing. Wire rope chairs 200 on the right and left sides of the footing support the wire rope horizontally 50 as well as vertically 51. Concrete is placed from the base of the footing 2 to the ground surface 1, encasing the horizontal wire rope 50 and wire rope chairs 100 and 200 in the concrete footing 3.

The completed wall section shown in FIG. 1 is composed of modular hollow core wall units including full-size units 60 and half-sized units 61 that also have hollow cores, laid in a running bond pattern from courses one [1] through eleven [11]. Horizontal 70 and vertical 71 mortar joints hold the wall units in place. The vertical webs 62 on the inside of the wall units provide hollow cores on both sides to accommodate the vertical wire rope 51. Bond beams 67, or equivalent, provide open channels to accommodate horizontal wire rope 54, shown at courses five [5] and nine [9]. The horizontal wire rope 54 in the bond beams 67 join the wire rope connectors 300, which will sometimes be referred to herein as engagement elements, on the left and right sides of the wall shown in FIG. 1.

The vertical cores of the wall units on the left and right sides of the wall are filled with grout 4, or equivalent, and horizontal channels in the bond beams are filled with grout 5, encasing the vertical wire ropes 51, the horizontal wire ropes 54, and the wire rope connectors 300. The grouted cores provide structural support by the continuous horizontal wire rope in the footing 50 interconnected with the continuous wire rope in the vertical cores 51, and the horizontal wire ropes in the bond beams 54 when the cores are filled with grout. A sill plate 73 is placed on the completed wall section in this example. The wall section shown in FIG. 1 is an example only; other hollow cores could be reinforced using the same methods and apparatus depending on the building design requirements and applicable building codes. The step-by-step construction of the structural wall shown in FIG. 1 is described in detail in association with FIG. 11 (FIG. 11A through FIG. 11AP show multiple side elevation views of example construction steps).

Figure 2:
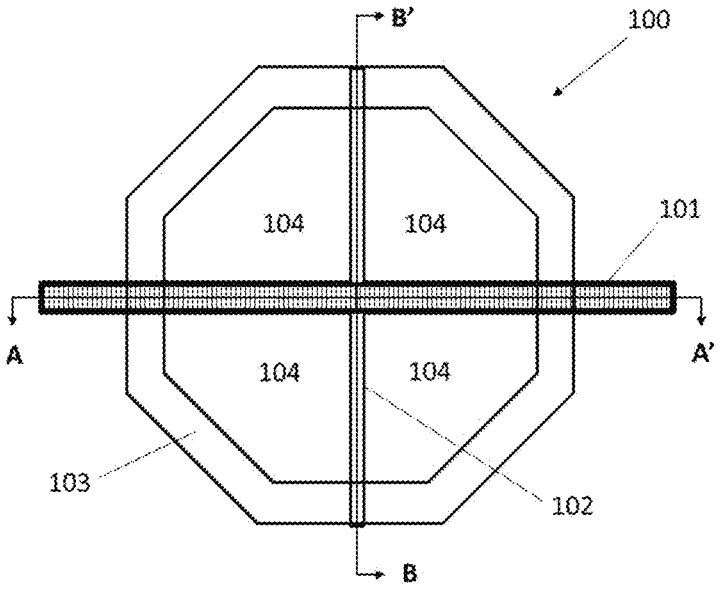
FIG. 2 is an overhead view of a device used to support wire rope horizontally in a footing, referred to in the present disclosure as a wire rope chair, according to at least one embodiment.

FIG. 2 is an overhead view of a wire rope chair 100 used to support wire rope horizontally in a footing, according to at least one embodiment. An extended support arm 101 holds the wire rope at a distance beyond the base 103 of the wire rope chair as shown in the cross-section line A to A' in FIG. 3A. A cross brace 102 provides support to the extended support arm 101 by a center connection. The cross brace 102 and the extended arm support 101 are both connected to the base 103 for additional support. The base 103 has openings 104.

Figure 3A:
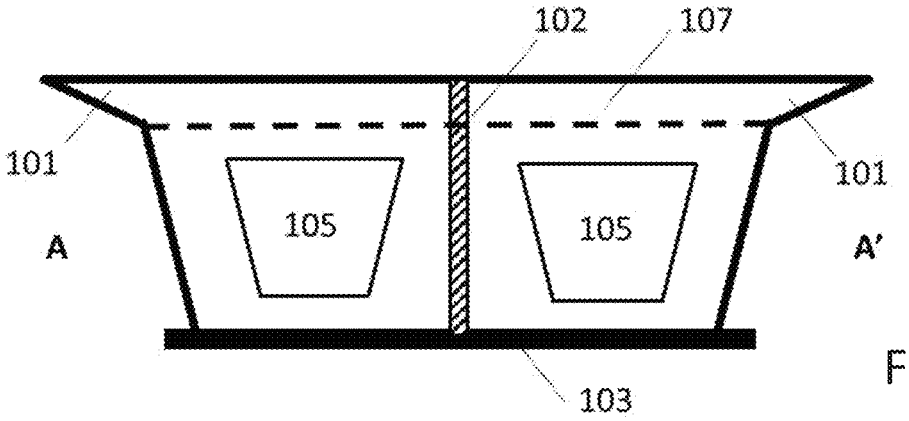
FIG. 3A is a side elevation view of an extended support arm of a wire rope chair used to support wire rope horizontally in a footing, according to at least one embodiment.

FIG. 3A is a side elevation view (A to A') of an extended support arm 101 of a wire rope chair 100 used to support wire rope horizontally in a footing, according to at least one embodiment. FIG. 3A shows the connection of the cross brace 102 with the extended support arm 101 and the connection of both to the base 103. The extended support arm 101 has openings 105.

Figure 3B:
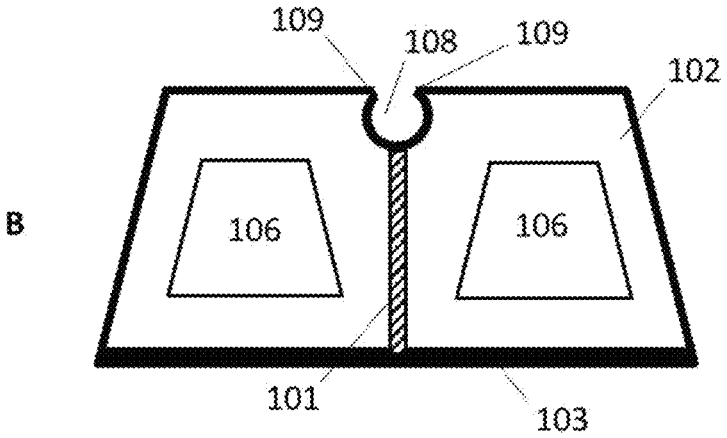
FIG. 3B is a side elevation view of a cross brace of a wire rope chair used to support wire rope horizontally in a footing, according to at least one embodiment.

FIG. 3B is a side elevation view (B to B') of a cross brace 102 of wire rope chair 100 used to support wire rope horizontally in a footing, according to at least one embodiment. The top of the cross brace 102 shows the partial circular trough 108 for securing the wire rope, which is held in place by tabs 109 along the length of the extended support arm 101. The cross brace 102 has open areas 106.

The open areas 104 on the base 103 in FIG. 2, the open areas 105 on the extended support arm 101 in FIG. 3A, and the open areas 106 in the cross brace 102 in FIG. 3B make the wire rope chair 100 lightweight, and more importantly, provide areas for the concrete in the footing 3 to flow into the devices 100 and 200 for support as shown in FIG. 1. The height of the wire rope chair 100 is such that a sufficient concrete cover will be provided when properly installed in the excavation for the footing as shown in FIG. 1. The wire rope chair may be made of a corrosion resistant plastic or similar material.

Figure 4:
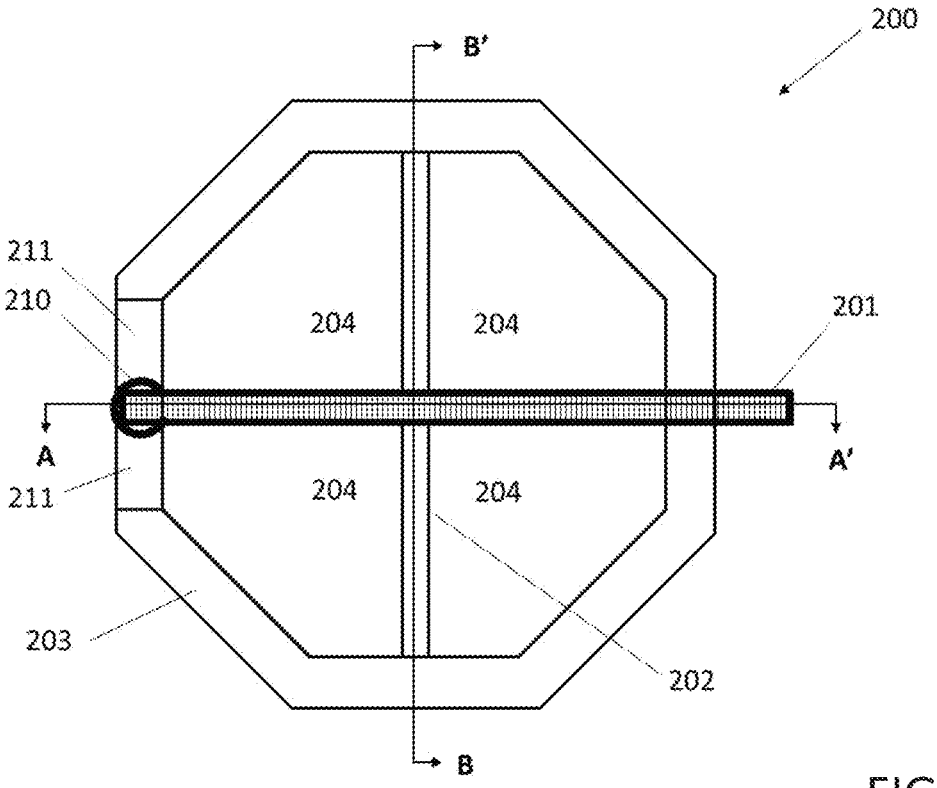
FIG. 4 is an overhead view of a device used to support wire rope horizontally and vertically in a footing, referred to in the present disclosure as a wire rope chair, according to at least one embodiment.

FIG. 4 is an overhead view of a wire rope chair 200 used to support wire rope both horizontally and vertically in a footing, according to at least one embodiment. An extended support arm 201 holds the wire rope at a distance beyond the right side of the base 203 of the wire rope chair as shown in the cross-section line A to A' in FIG. 5. A cross brace 202 provides support to the extended support arm 201 by a center connection. The cross brace 202 and the extended arm support 201 are both connected to the base 203 for additional support. The base 203 has openings 204.

Figure 5:
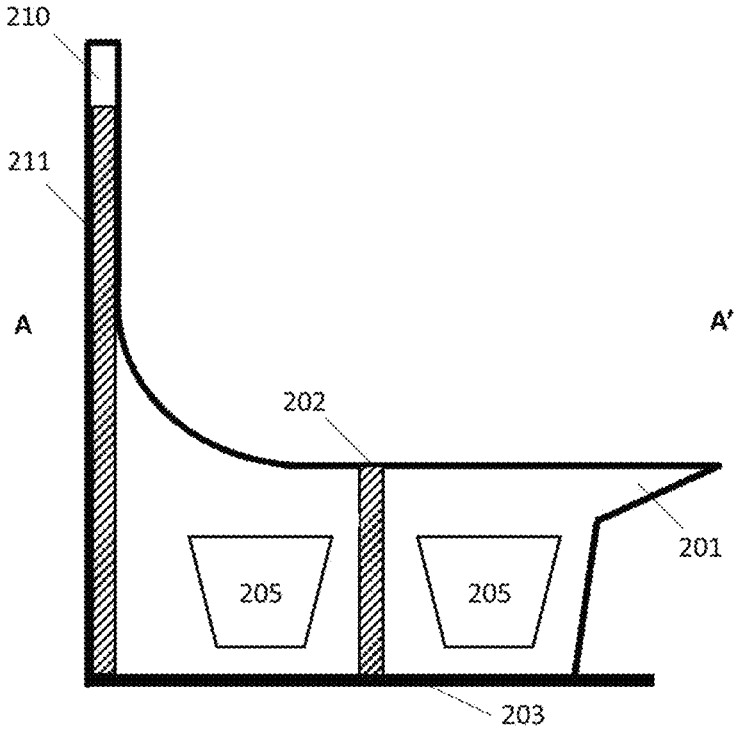
FIG. 5 is a side elevation view of an extended support arm of a wire rope chair used to support wire rope horizontally and vertically in a footing, according to at least one embodiment.
Figure 6:
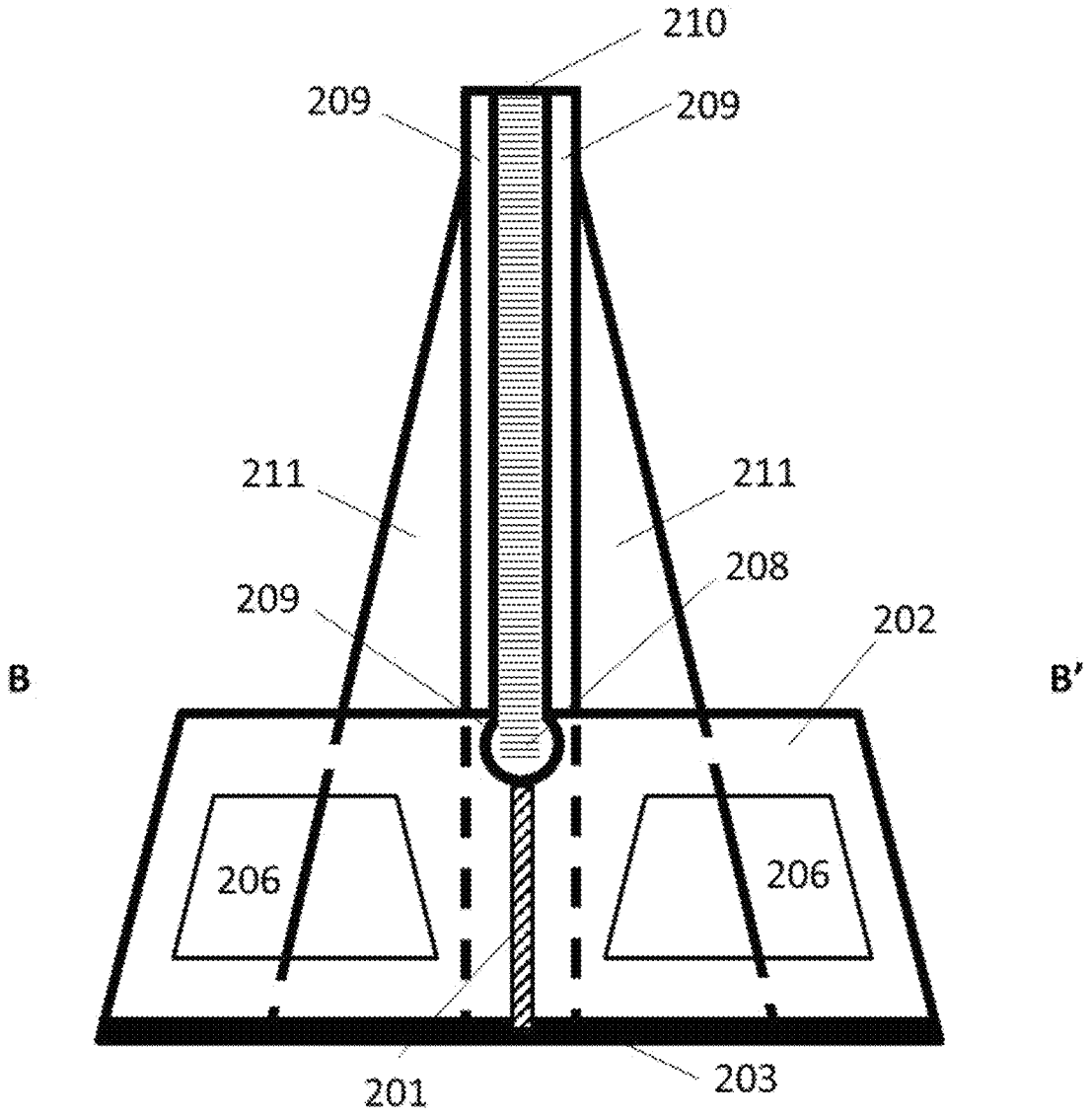
FIG. 6 is a side elevation view of a cross brace of a wire rope chair used to support wire rope horizontally and vertically in a footing, according to at least one embodiment.

The wire rope chair 200 has a vertical support arm 210 incorporated in a vertical support brace 211 that is connected to the base 203. Cross sectional views of A to A' and B to B' identified in FIG. 4 are shown in FIG. 5 and FIG. 6, respectively. FIG. 5 shows the end sections of the center cross brace 202 and the vertical support brace 211. The extended support arm 201 has openings 205. The vertical support arm 210 extends above the extended support arm 201 as shown in FIG. 5, such that the vertical wire rope 51 shown in FIG. 1 extends above the concrete footing 3.

FIG. 6 is a side elevation view (B to B') of a cross brace 202 of wire rope chair 200 used to support wire rope horizontally and vertically in a footing, according to at least one embodiment. The top of the cross brace 202 shows the partial circular trough 208 for securement of the wire rope, which is held in place by tabs 209 along the length of the extended support arm 201. The cross brace 202 has open areas 206. The vertical support brace 211 connects with the base 203 and is partially visible through the open areas 206 and extends above the cross brace 202 as shown in FIG. 6. The partial circular trough extends vertically 210 and uses tabs 209 to hold the wire rope in a vertical position (described in more detail in association with the description for FIG. 11).

Figure 7A:
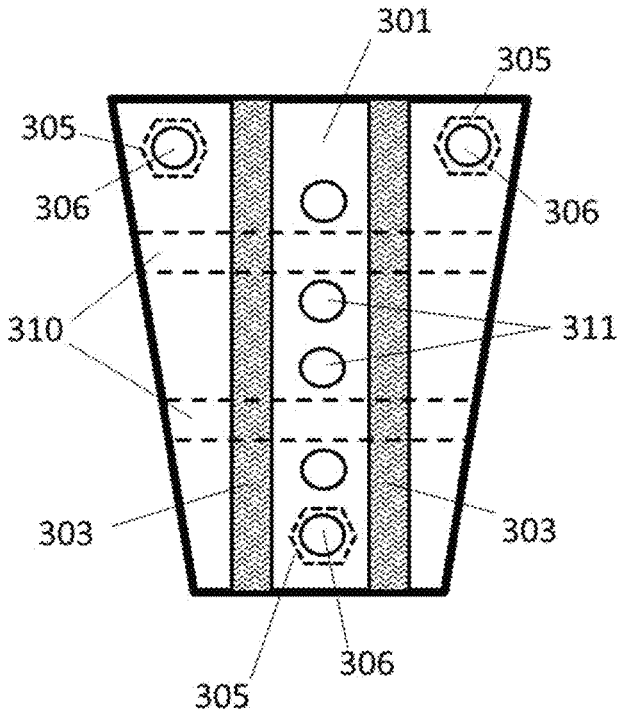
FIG. 7A is a side elevation view of the bottom of a device that can be used to connect multiple wire ropes together, referred to in the present disclosure as a wire rope connector, according to at least one embodiment.

FIG. 7A is a side elevation view of the bottom plate 301 of a device that can be used to connect multiple wire ropes together from different directions, referred to in the present disclosure as a wire rope connector 300, according to at least one embodiment. The wire rope connector 300 can also serve as an anchor when secured in grout or concrete. The bottom plate 301 has parallel ridged channels 303 on the inside of the bottom plate, and parallel ridged channels 310 on the outside of the bottom plate 301 that are at an opposing angle. Unthreaded holes 306 through the bottom plate align with nuts 305 that are attached to the outside of the bottom plate. Unthreaded holes 311 through the bottom plate 301 are on both sides of the parallel ridged channels 310 that are on the outside of the bottom plate 301, used for U-bolts, described for FIG. 7C.

Figure 7B:
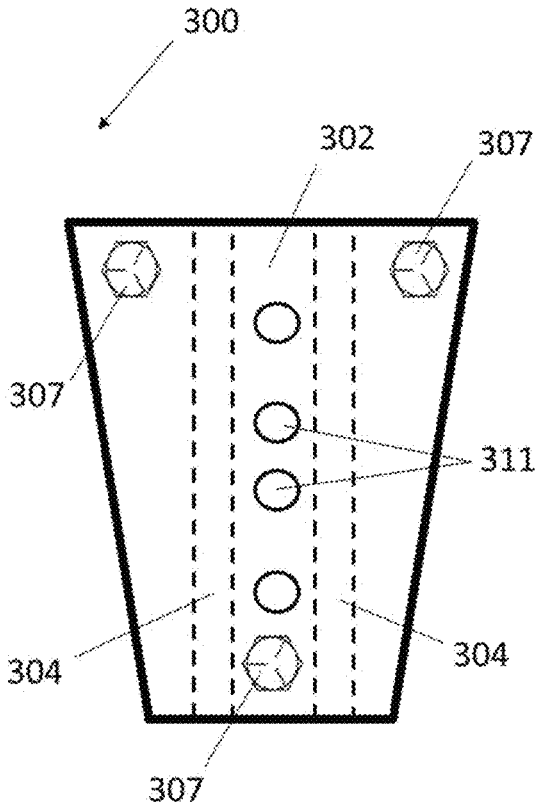
FIG. 7B is a side elevation view of the top of a wire rope connector, according to at least one embodiment.

FIG. 7B shows a top plate 302 with parallel ridged channels 304 on the inside of the top plate. Bolt heads 307 are shown on the outside of the top plate in FIG. 7B.

Figure 7C:
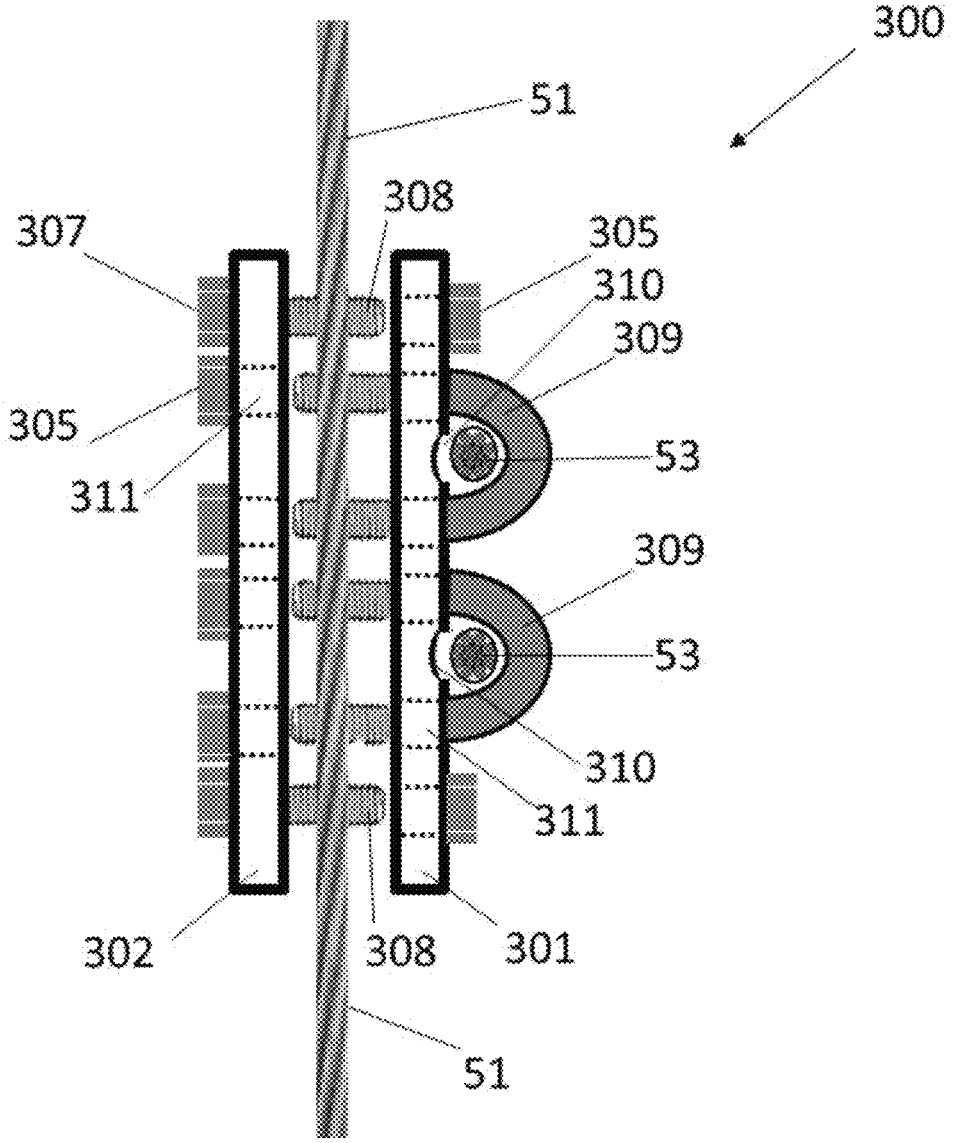
FIG. 7C is side elevation view of a wire rope connector, showing the connection of vertical and horizontal wire ropes, according to at least one embodiment.

FIG. 7C is a side elevation view of the wire rope connector 300 showing U bolts 309 or equivalent on the outside of the bottom plate 301 overlapping parallel ridged channels 310 and used with U-bolts 309 or equivalent to hold horizontal wire rope shown in cross section 53. Vertical wire rope 51 is also shown if FIG. 7C before the wire rope connector 300 is bolted 307 together.

FIG. 8A is an overhead view of a wire rope connector 300 in an open position, showing the alignment of the parallel ridged channels 304 on the inside of the top plate 302 with the parallel ridged channels 303 on the inside of the bottom plate 301. The threaded length of the bolt 308 align with the nuts 305 fixed on the outside of the bottom plate 301. The U-bolt or equivalent 309 extends from the outside of the bottom plate 301.

FIG. 8B is an overhead view of a wire rope connector 300 in an open position with two wire rope sections 53 shown in the channels of the bottom plate 301.

FIG. 8C is an overhead view of a wire rope connector 300 in a closed position compressing the wire rope sections 53 in the parallel ridged channels 304 and 303 of the inside of the top and bottom plates, respectively. The bolt head 307 is torqued into the nut 305 attached to the bottom plate 301 exposing a threaded portion 308 of the bolt. The bolts are equally torqued such that the parallel ridged channels 304 and 303 grip the wire rope sections 53 between the top 302 and bottom 301 plates minimizing movement of the wire rope when loads are applied.

Figure 9A:
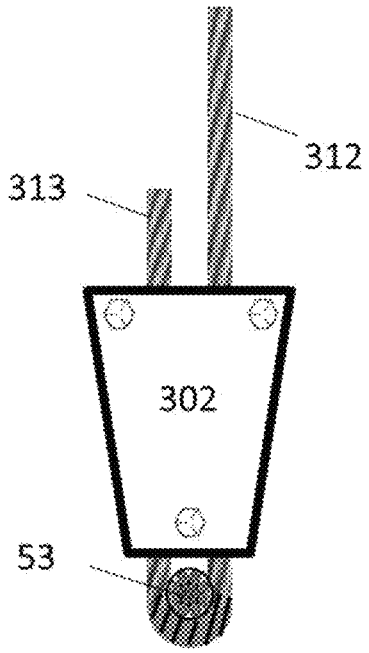
FIG. 9A is a side elevation view of a wire rope connector securing a single wire rope around another wire rope at the bottom of the wire rope connector.

FIG. 9A is a side elevation view of a wire rope connector 300 securing a single wire rope around another section of wire rope shown in section 53. In this example, the vertical wire rope segment 310 represents a live load and wire rope segment 311 represents a dead end. Unlike conventional U-bolts and saddles used to secure wire rope, where it is important not to put the saddle on the dead end of a wire rope, the wire rope connector 300 provides sufficiently elongated ridged channels to secure the wire rope without having to make this distinction which is not consistently practiced in the field.

Figure 9B:
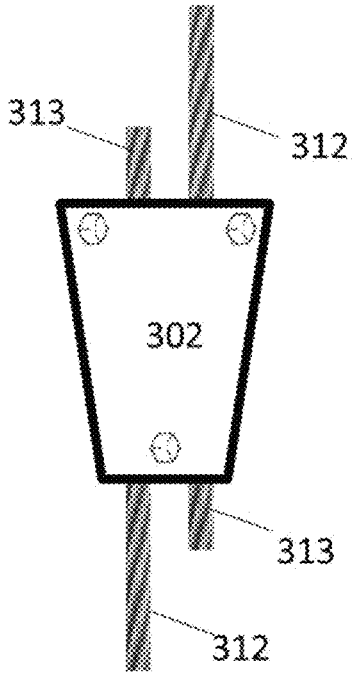
FIG. 9B is a side elevation view of a wire rope connector used to join two different wire ropes together.

FIG. 9B is a side elevation view of a wire rope connector 300 used to join different wire ropes together. In this example, the vertical wire rope segments 312 represent live loads and wire rope segments 313 represent dead ends.

Figure 9C:
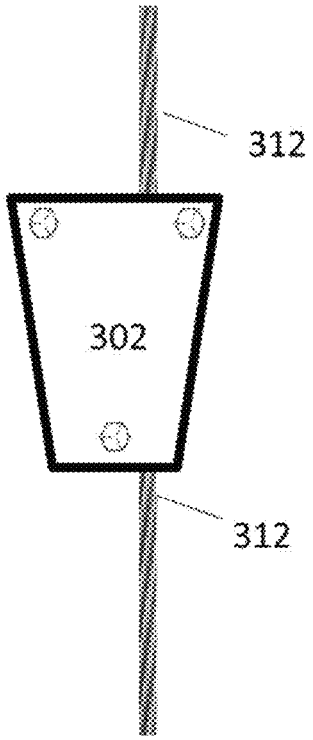
FIG. 9C is a side elevation view of a wire rope connector with a single wire rope.

FIG. 9C is a side elevation view of a wire rope connector 300 with a single vertical wire rope where both ends of the rope represent live loads 312.

FIG. 9D shows the same vertical wire rope examples of FIGS. 9A, 9B, and 9C with the addition of horizontal wire ropes connected to the outside of the bottom plate for an example of an interconnected assembly (refer to 53 and 309 in FIG. 7C).

FIG. 10A is an overhead view of a device 400 used to hold wire rope in place, referred to in the present disclosure as a wire rope pin, which will sometimes be referred to herein as a wedge pin, according to at least one embodiment. A beveled edge fork 401 is separated by a slot 402 that surrounds a wire rope.

FIG. 10B is a side elevation view of a wire rope pin 400, showing the beveled fork 401 and an elevated knock-out end 403 used to remove the pin. The function of the wire rope pin 400 is described in more detail in association with the description for FIG. 11.

FIG. 11 provides multiple side elevation views (FIG. 11A through FIG. 11AP) of example installation steps that could be followed to install a structurally reinforced vertical wall using the devices and methods described in the present disclosure, according to at least one embodiment. Although the term "step" may be expressly used or implied relating to features of processes or methods in association with FIG. 11, no implication is made of any particular order or sequence among such expressed or implied steps unless an order or sequence is explicitly stated.

Figure 11A:
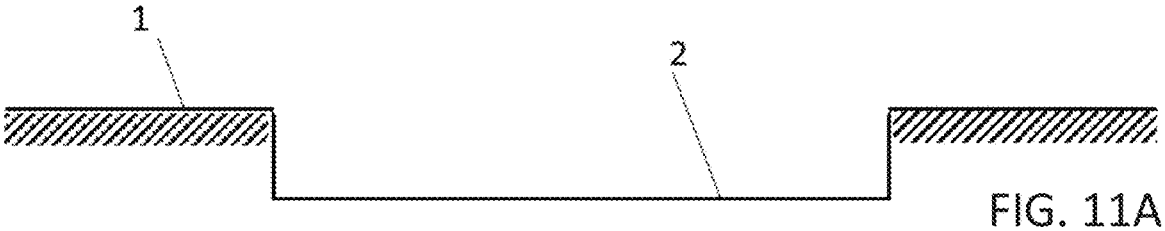
FIGS. 11A to 11AP provides multiple side elevation views (FIG. 11A through FIG. 11AP) of example installation methods that could be followed in a series of steps to install a structurally reinforced vertical wall using the devices and methods described in the present disclosure, according to at least one embodiment.
Figure 11B:
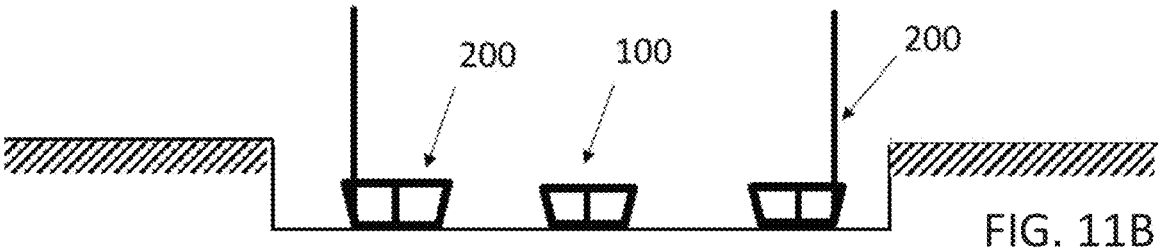
Figure 11C:
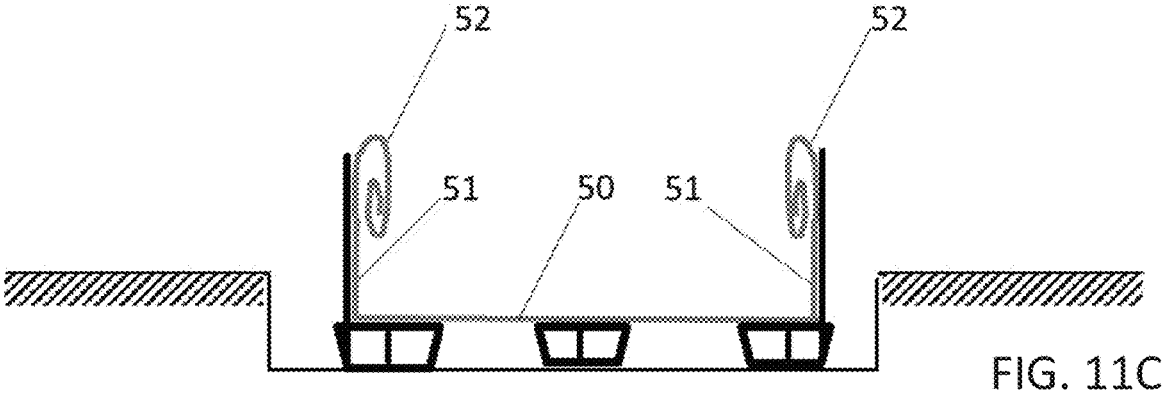
Figure 11D:
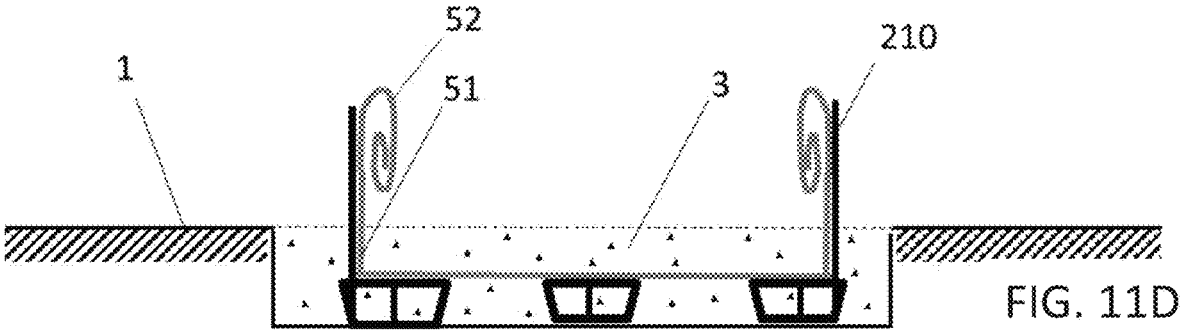

FIG. 11A shows a ground surface 1 that has been excavated to a depth 2 to form a footing to support a wall. FIG. 11B shows the placement of a wire rope chair 100 in the center of the excavation. Wire rope chairs 200 are placed at the right and left sides of the excavation. FIG. 11C shows the installation of wire rope horizontally 50 on chairs 100 and 200, and vertically 51 on wire rope chairs 200. The excess wire rope is represented as a coil 52 above the ground surface 1 on chairs 200. FIG. 11D shows the placement of concrete level with the ground surface 1 to form the footing 3 and encases the chairs 100 and 200, the horizontal wire rope 50, and a portion of vertical wire rope 51. The other portion of the vertical wire ropes 51, and the excess wire rope coils 52, remain above the ground surface 1, held by the vertical support arms 210 incorporated in the vertical support braces 211 that are connected to the base 203 of the wire rope chair 200 (see FIG. 5).

Figure 11E:
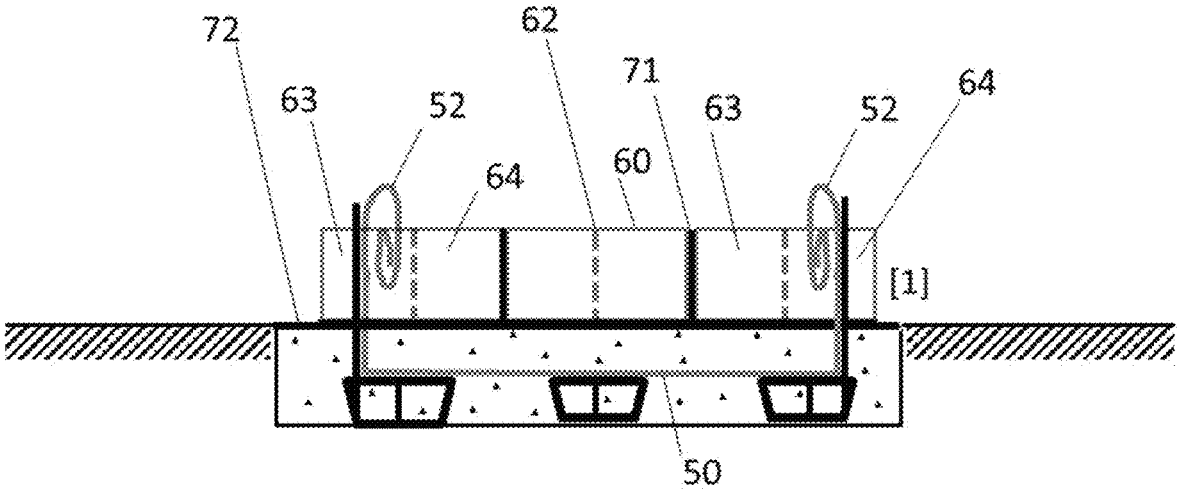

FIG. 11E shows the installation of the first course [1] of hollow core wall units on a mortar bed 72 on top of the concrete footing 3. Three full-size wall units 60 are used for the first course [1]. The left core 63 of each full-size wall unit is separated from the right core 64 by a web 62. Mortar is placed on the ends of the wall units to form vertical joints 71. The left core 63 of the leftmost wall unit is placed over the wire rope coil 52 which is connected to the vertical support arm 210 of the wire rope chair 200 (see FIG. 11D). The right core 64 of the rightmost wall unit is placed over the wire rope coil 52 which is connected to the vertical support arm 210 of the wire rope chair 200 (see FIG. 11D).

Figure 11F:
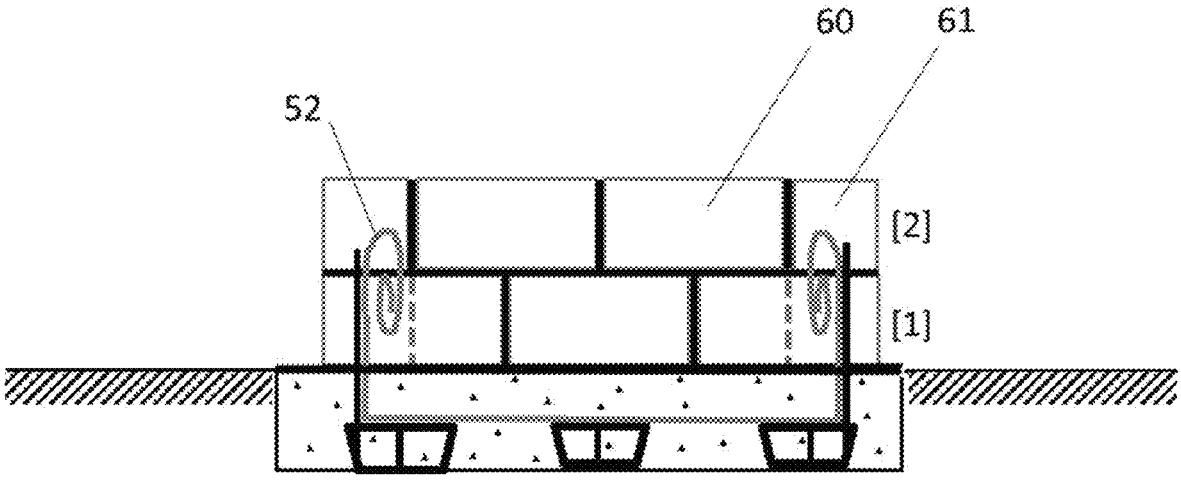

FIG. 11F shows the installation of the second course [2] of wall units on the first course [1] separated by a horizontal mortar joint 70. Full-size wall units 60 are used with half-size units 61 to form the second course [2]. As necessary, the coiled wire rope 52 is pulled upward in the hollow cores as the wall progresses upward.

Figure 11G:
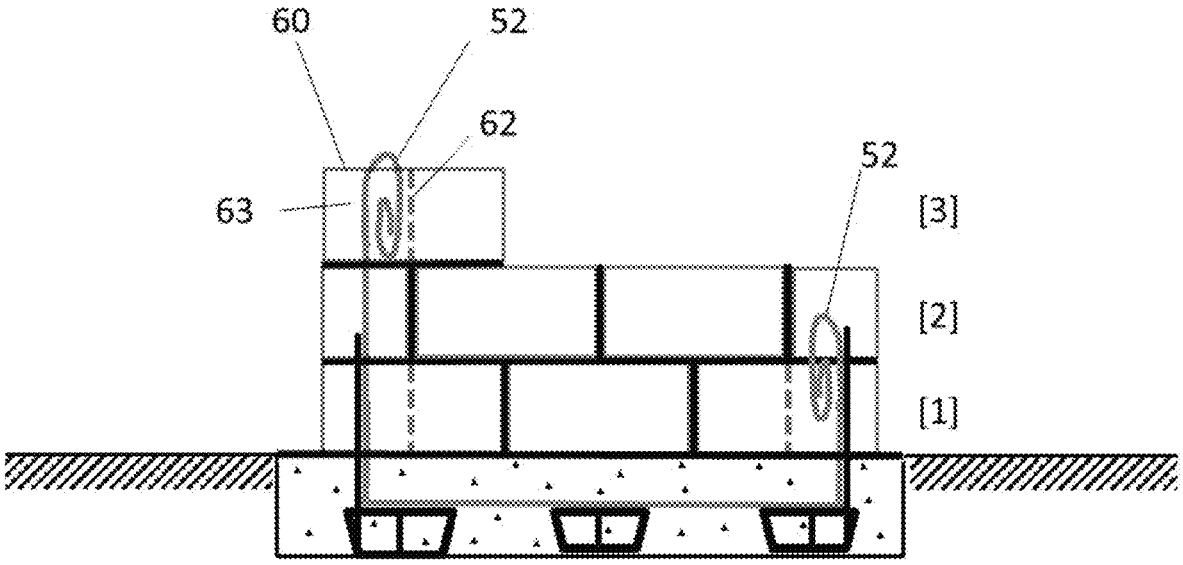
Figure 11H:
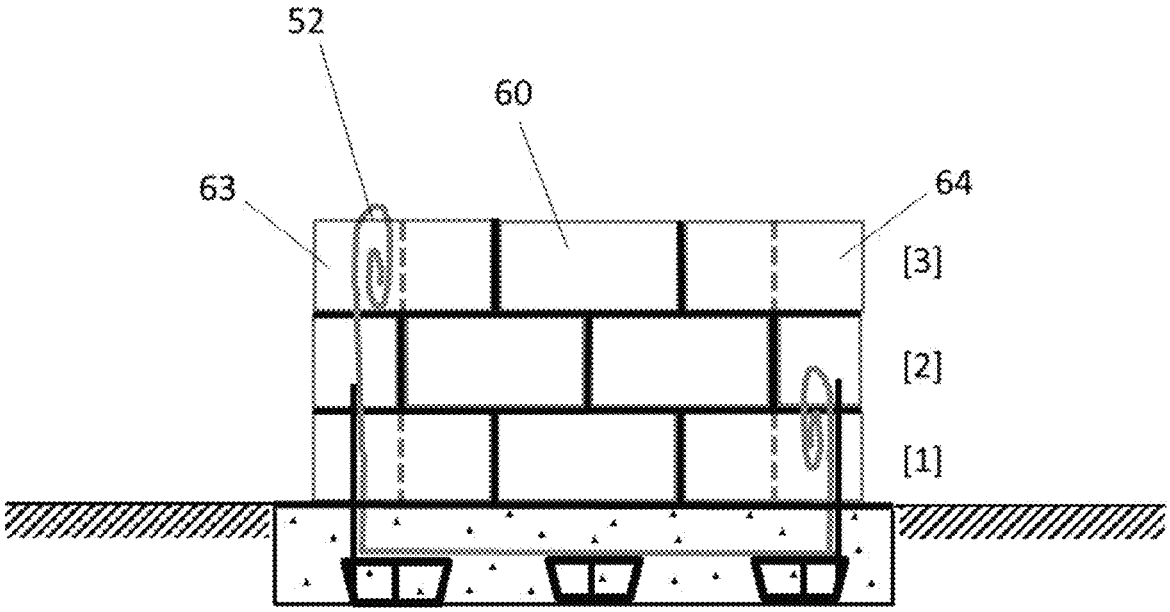

FIG. 11G shows the start of the third course [3] with a full-size wall unit 60 placed over the coiled wire rope 52 in the core 63 to the left of the web 62. FIG. 11H shows the completion of the third course [3] using full-size wall units 60.

Figure 11I:
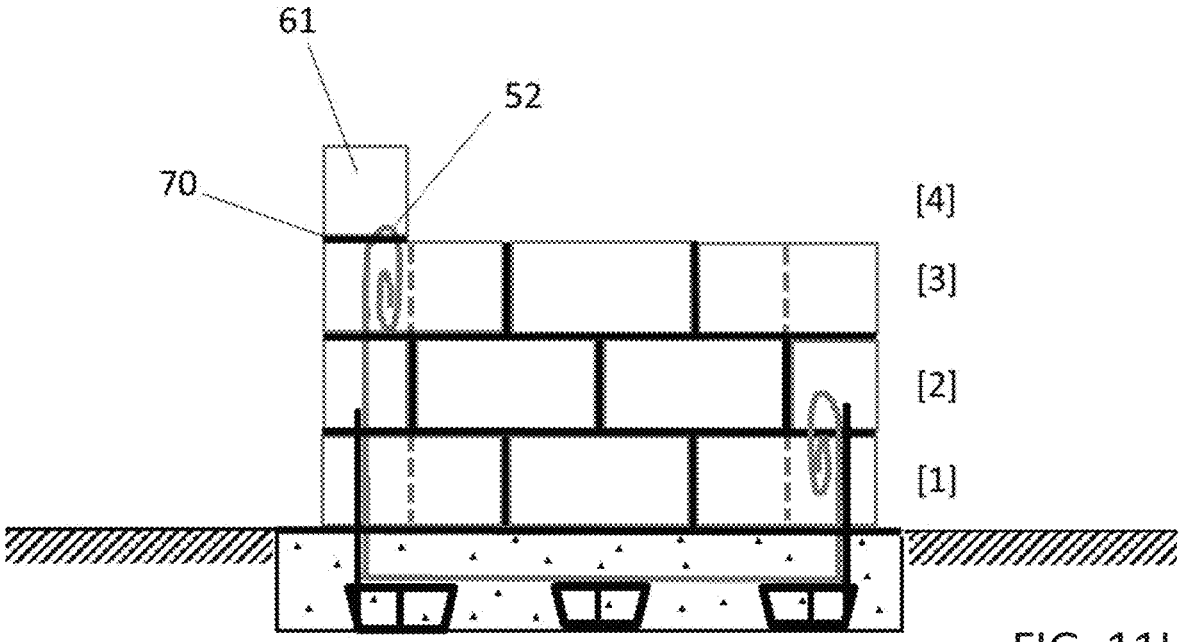
Figure 11J:
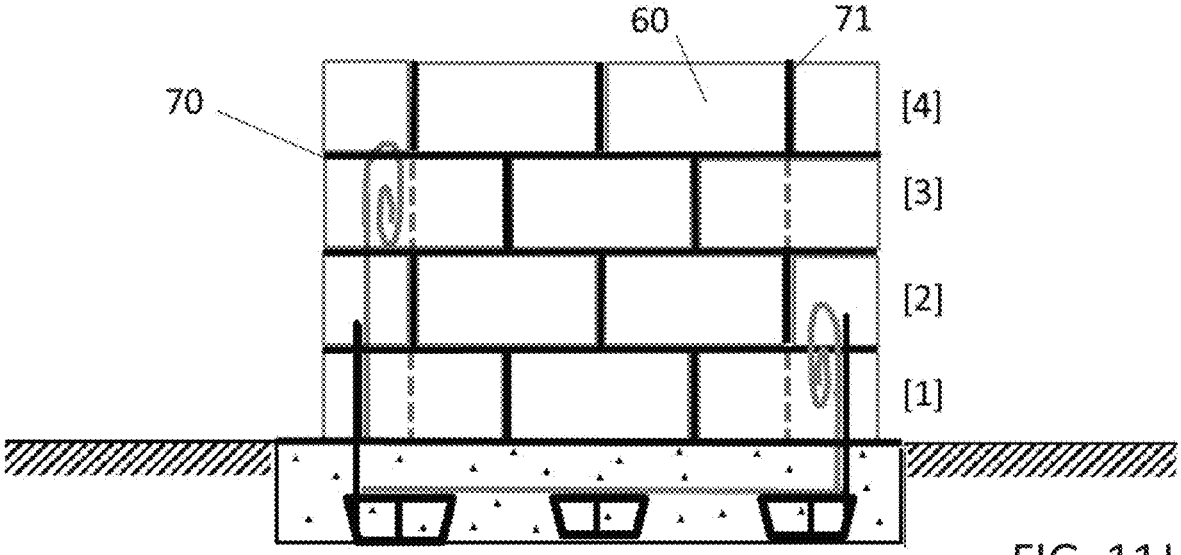

FIG. 11I shows the start of the fourth course [4] with a half-size unit 61, placed over the coiled wire rope 52 on a horizontal mortar joint 70. FIG. 11J shows the completion of the fourth course [4] of wall units. As necessary, the wire rope coils 52 are pulled upward in the hollow cores as the wall progresses upward.

Figure 11K:
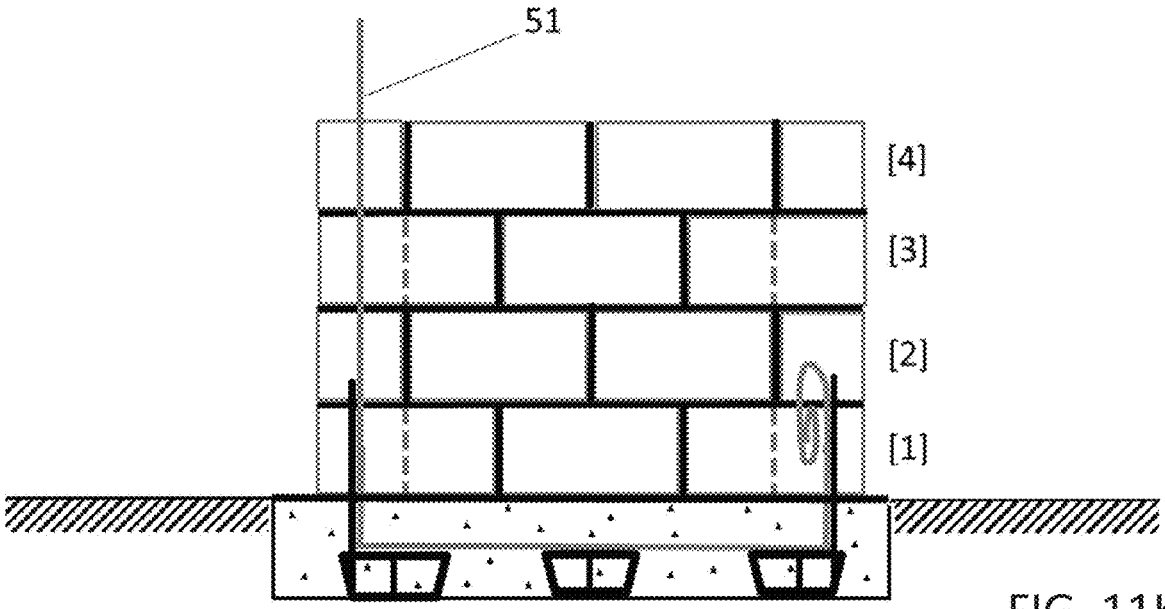
Figure 11L:
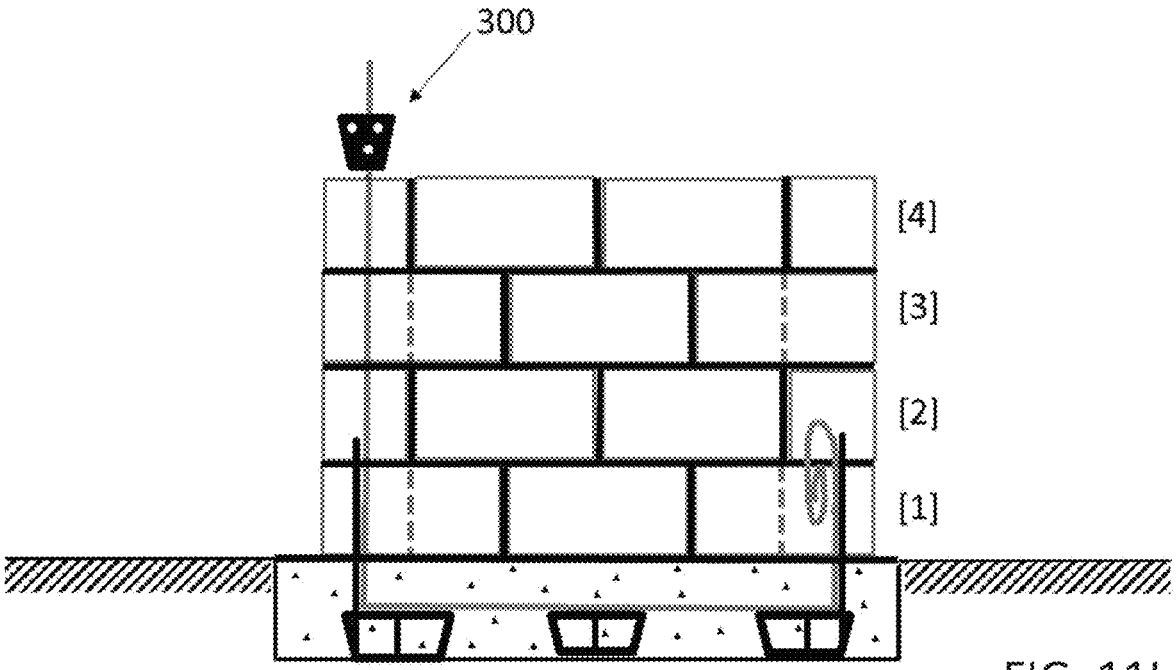
Figure 11M:
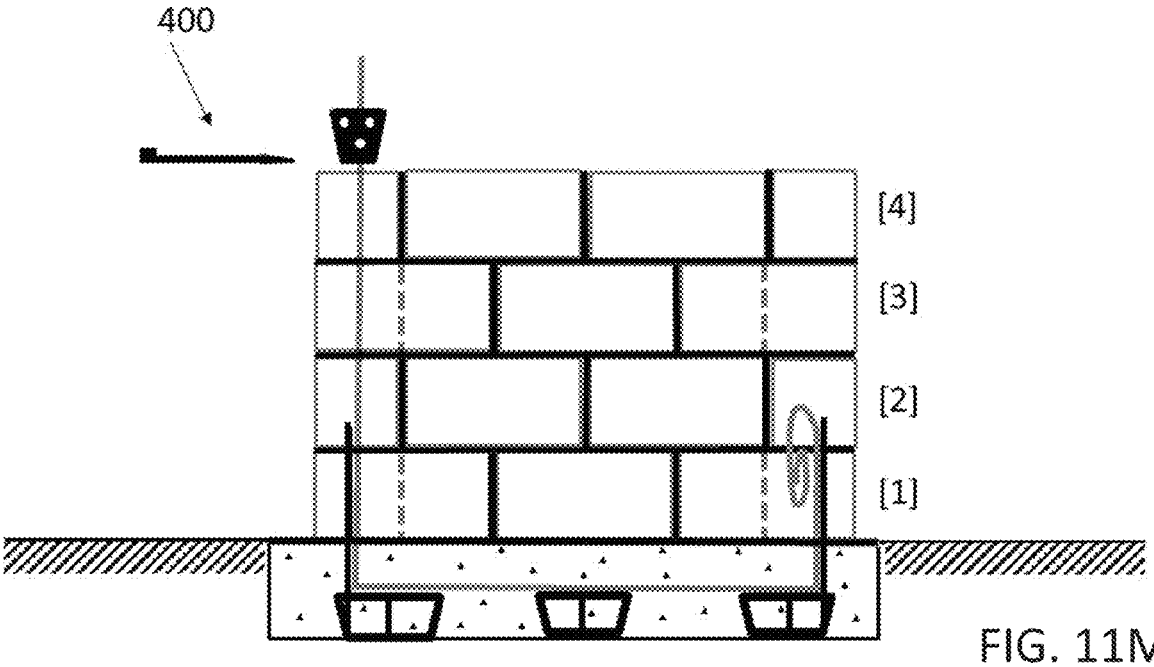
Figure 11N:
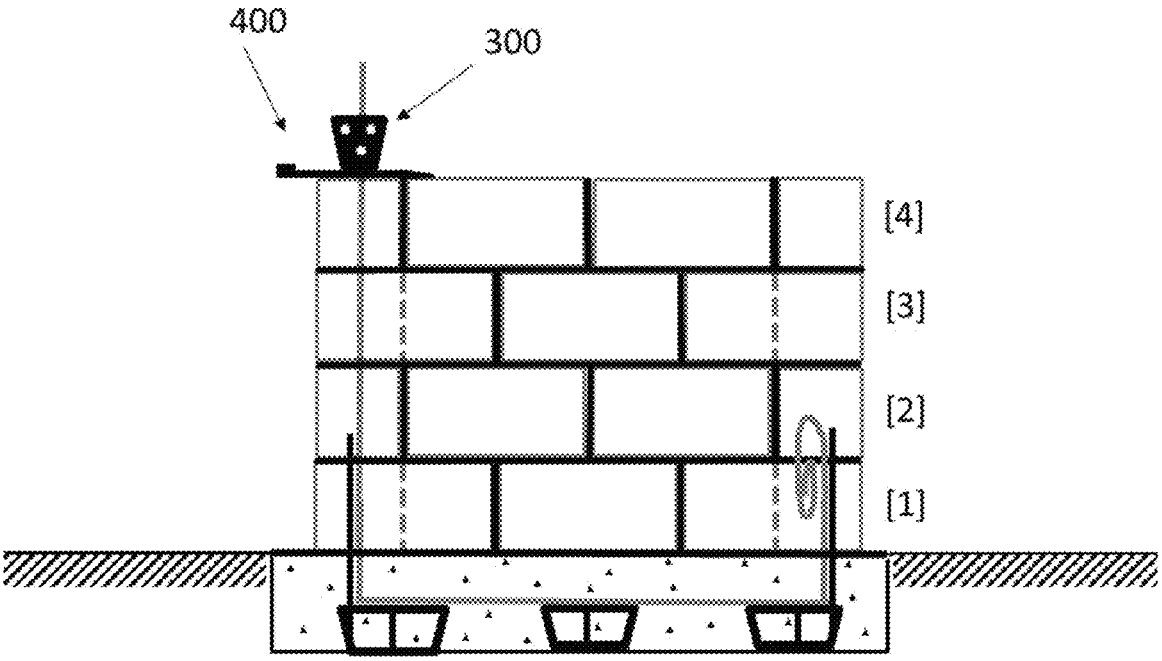

In FIG. 11K, the wire rope is pulled straight and upward 51 by hand through the hollow cores of first four courses [1-4] on the left of the wall. In FIG. 11L a wire rope connector 300 is secured to the wire rope 51. In FIG. 11M a wire rope pin 400 is selected for the small space between the wall unit and the wire rope connector 300. In FIG. 11N the wire rope pin 400 is inserted in the small space between the wall unit and the wire rope connector 300. The wedge design of the wire rope pin 400 holds the straightened wire rope 51 under a small amount of tension, primarily to keep the wire straight at least until grout is used to fill the hollow cores in subsequent steps. In some cases, where there is sufficient clearance for adding mortar for the next course, the wire rope pin 400 can be left in place and grouted within the wall.

Figure 11O:
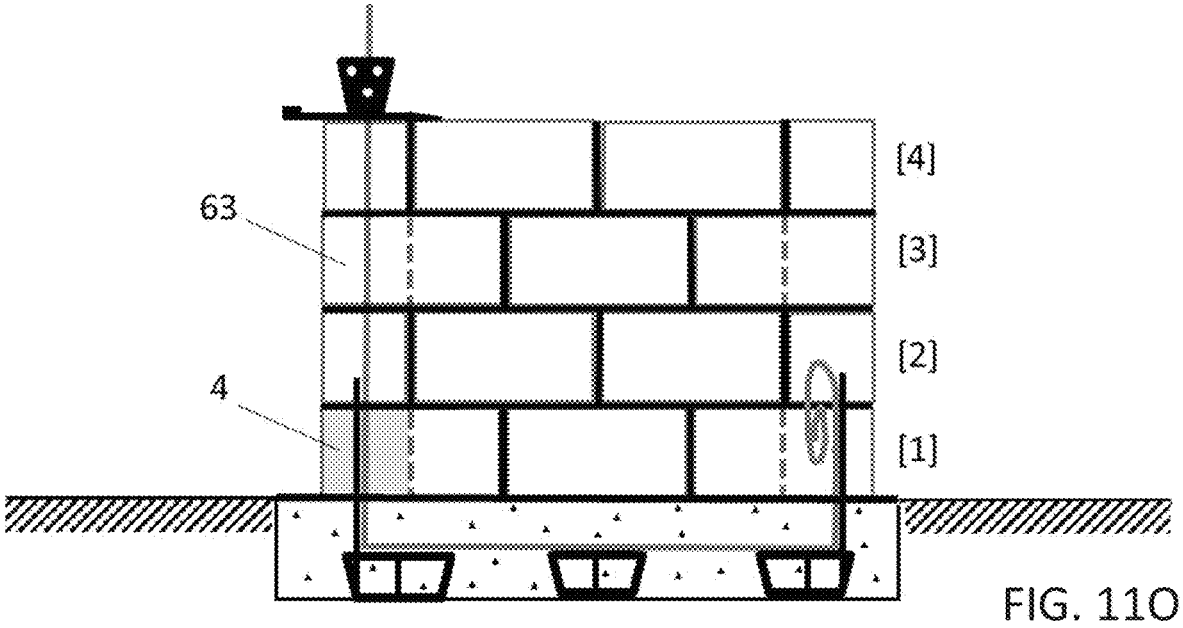
Figure 11P:
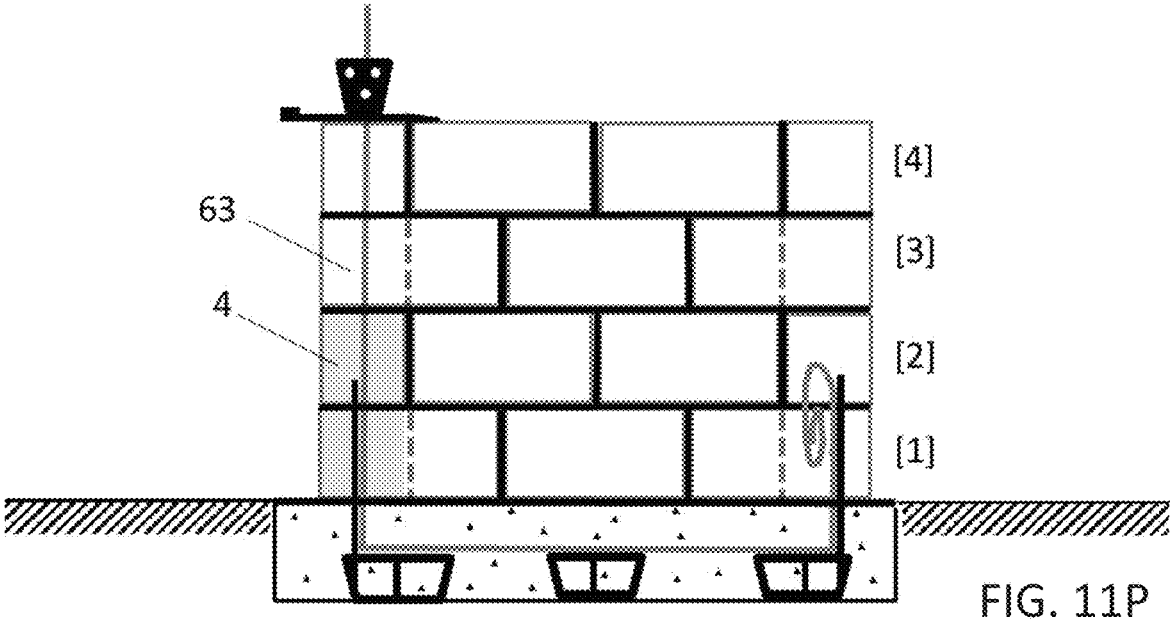
Figure 11Q:
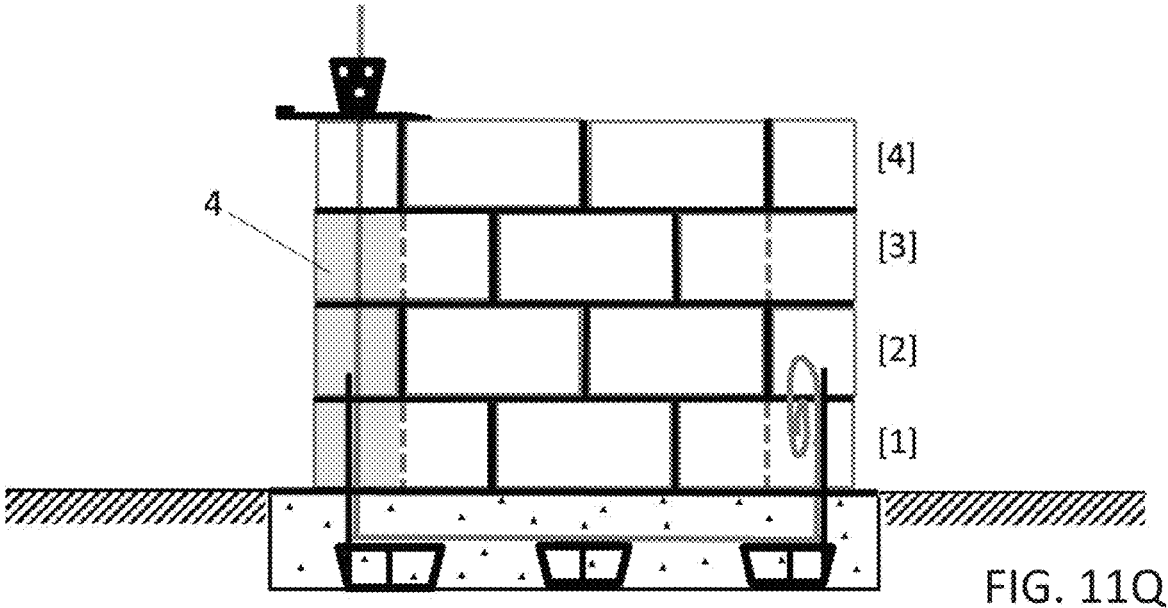
Figure 11R:
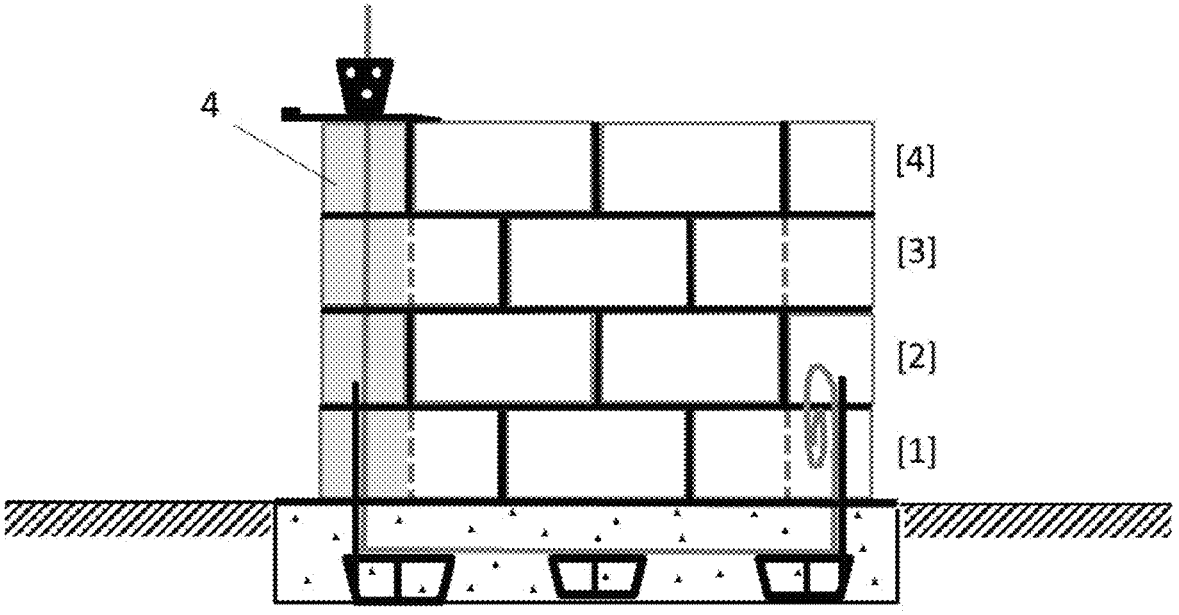

In FIG. 11O grout 4 is placed in the left cores 63 of the wall units, starting with the first course [1]. The grout is used to fill the left cores 63 in the second [2], third [3], and fourth [4] courses in FIGS. 11P, 11Q, and 11R, respectively.

Figure 11S:
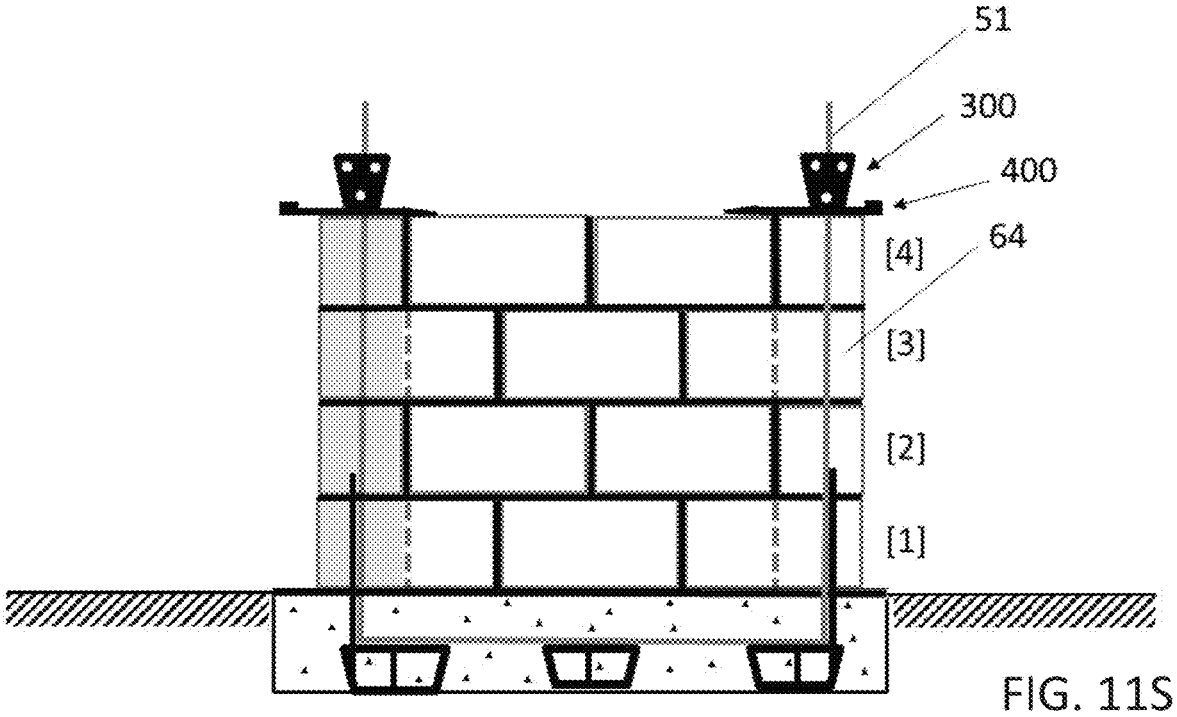
Figure 11T:
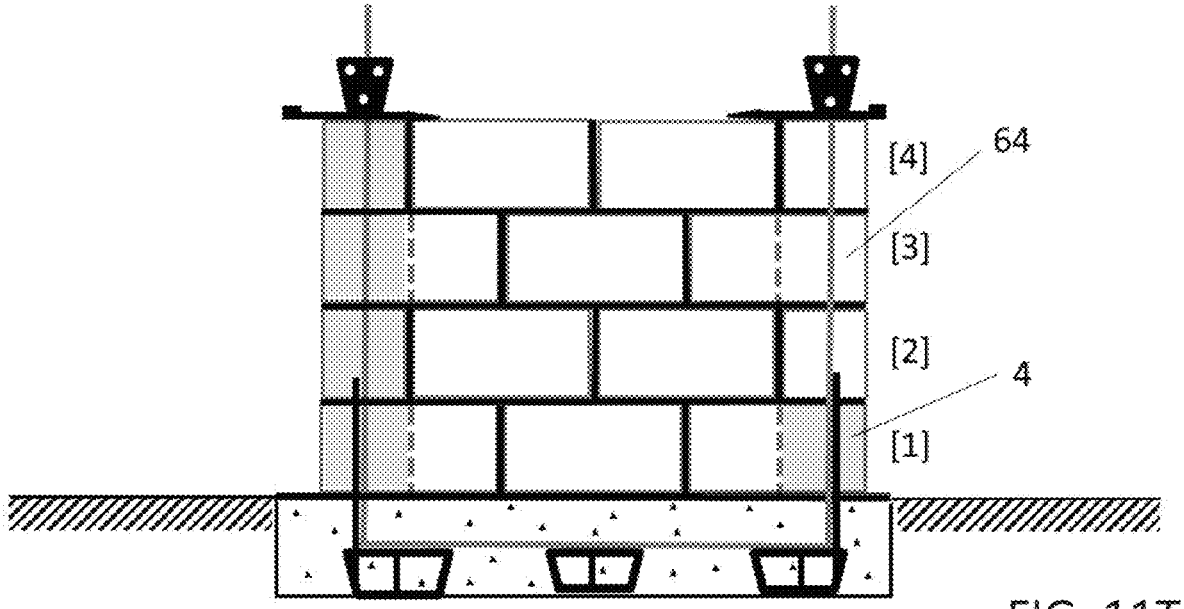
Figure 11U:
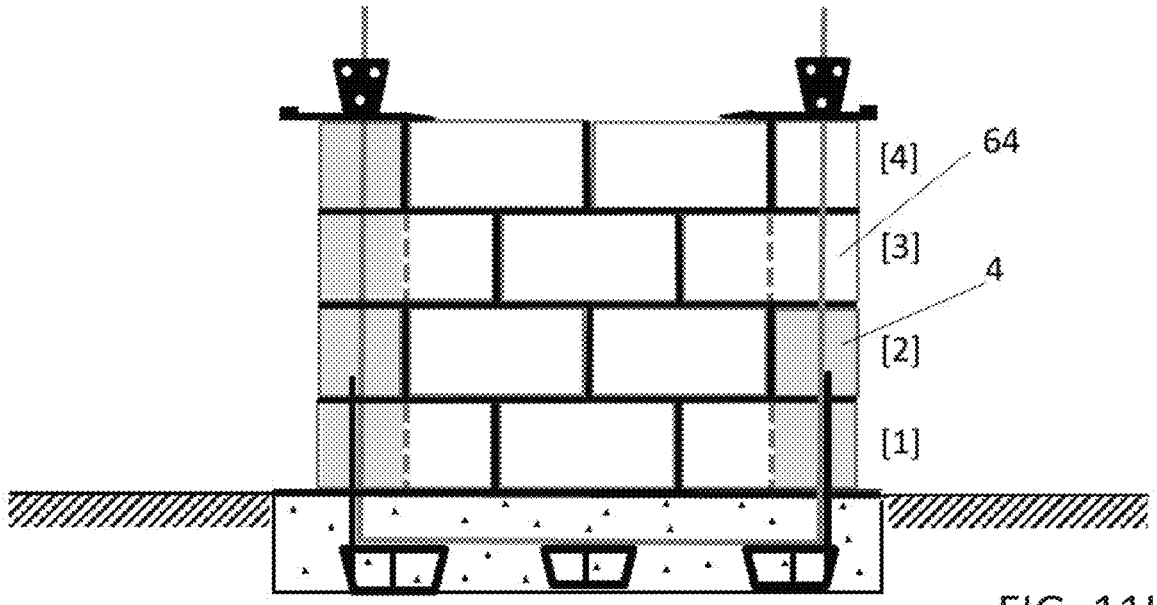
Figure 11V:
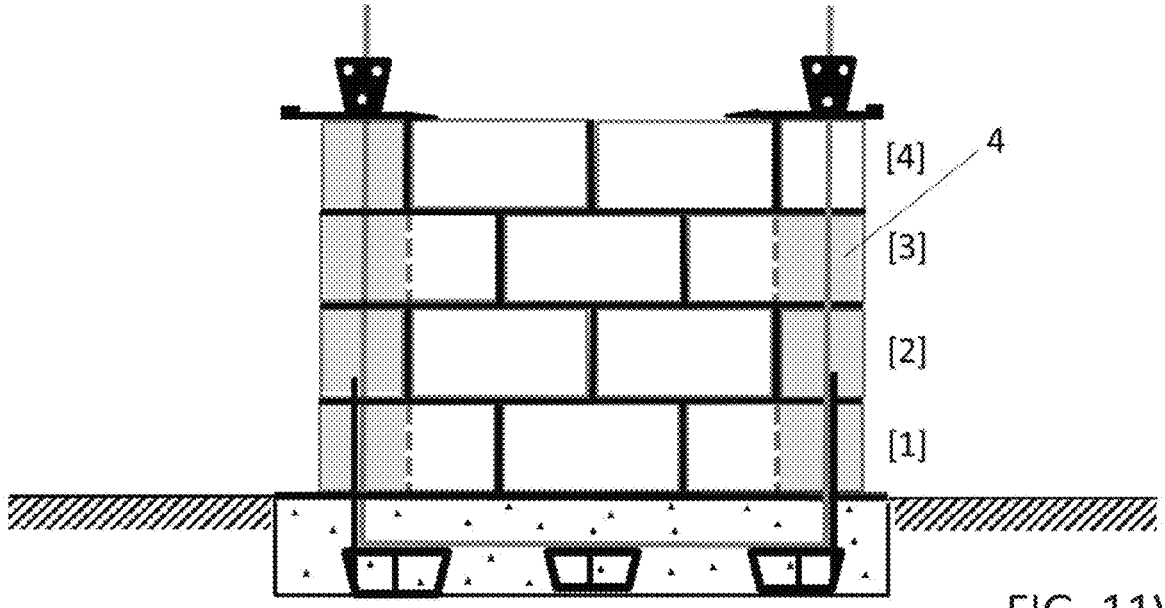
Figure 11W:
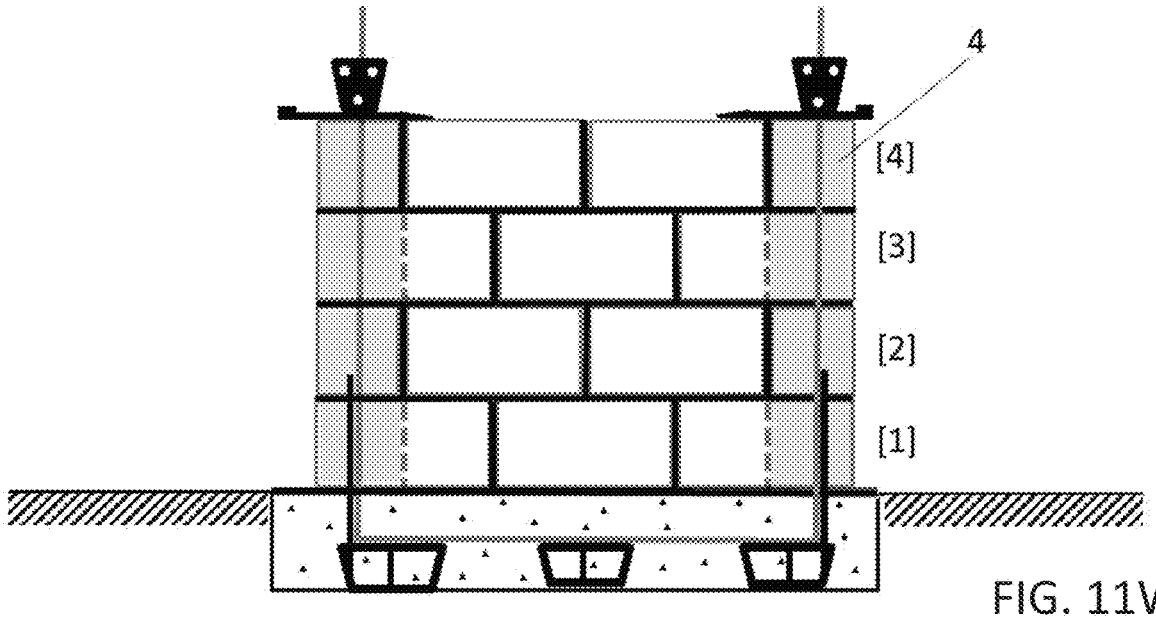

In FIG. 11S the wire rope in the right cores 64 is pulled straight 51 by hand through the first four courses [1-4] on the right of the wall. A wire rope connector 300 is secured to the wire rope 51. Grout is used to fill the right hollow cores 64 in the first through fourth courses [1-4] of the wall units as shown in FIGS. 11T, 11U, 11V, and 11W, respectively.

Figure 11X:
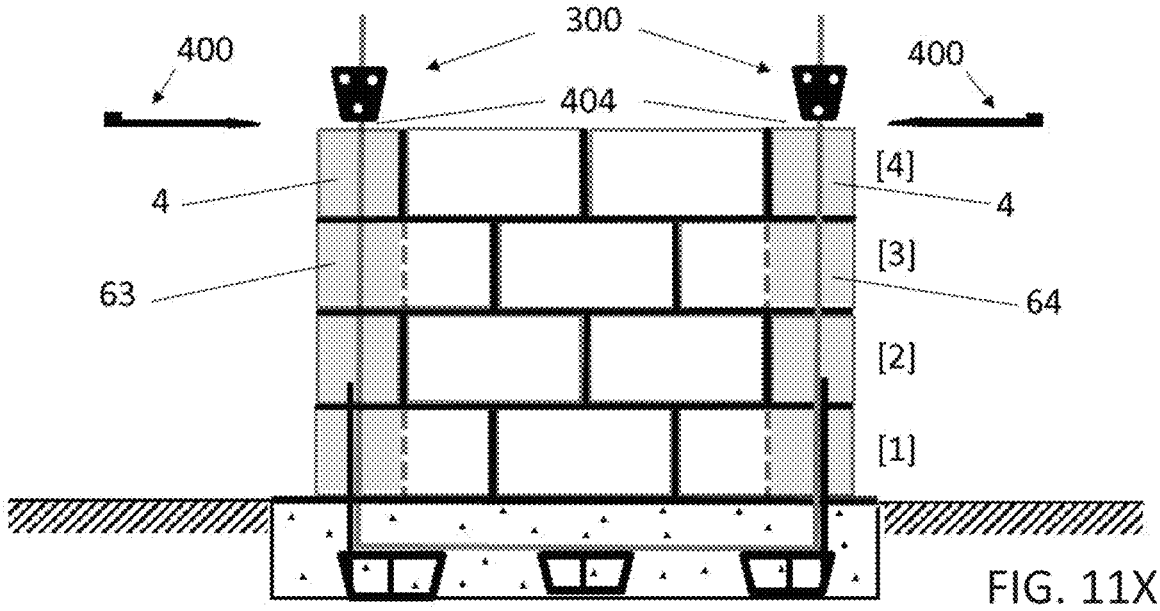

Once the grout 4 is set in the left hollow cores 63 and the right hollow cores 64 in the first through fourth courses [1-4] of the wall units as shown in FIG. 11X, the wire rope pins 400 are removed on both sides of the wall, leaving a small space 404 between the top of the grouted wall unit and the wire rope connectors 300. Alternatively, if there is sufficient clearance for adding mortar for the next course, the wire rope pins 400 can be left in place and grouted within the wall.

Figure 11Y:
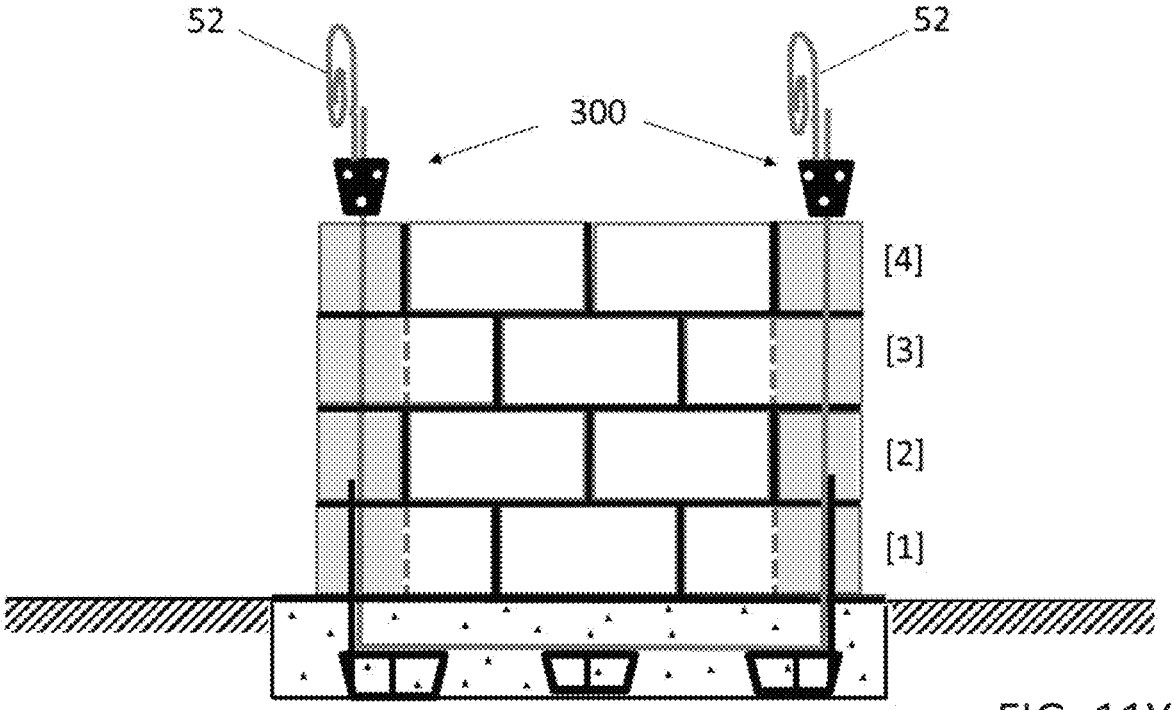

In the example application shown in FIG. 11Y, the wire rope connectors 300 are opened enough to insert the ends of additional coiled wire ropes 52 for continuing the construction and reinforcement of the wall.

Figure 11Z:
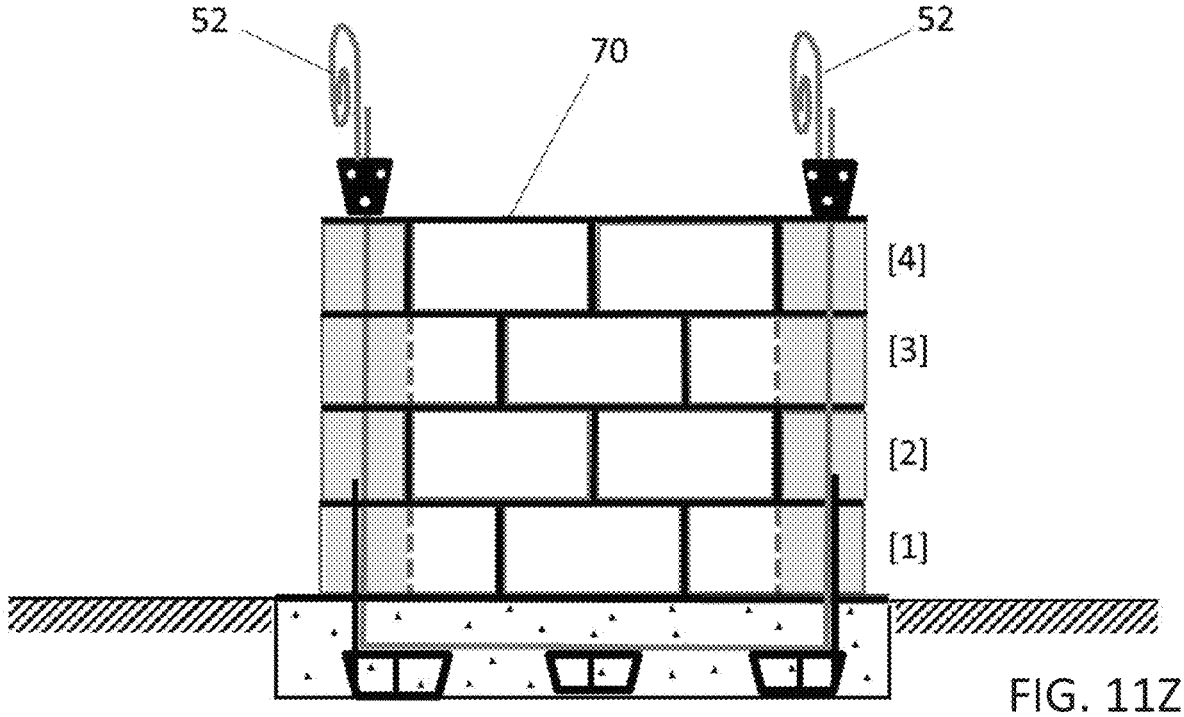
Figure 11A:
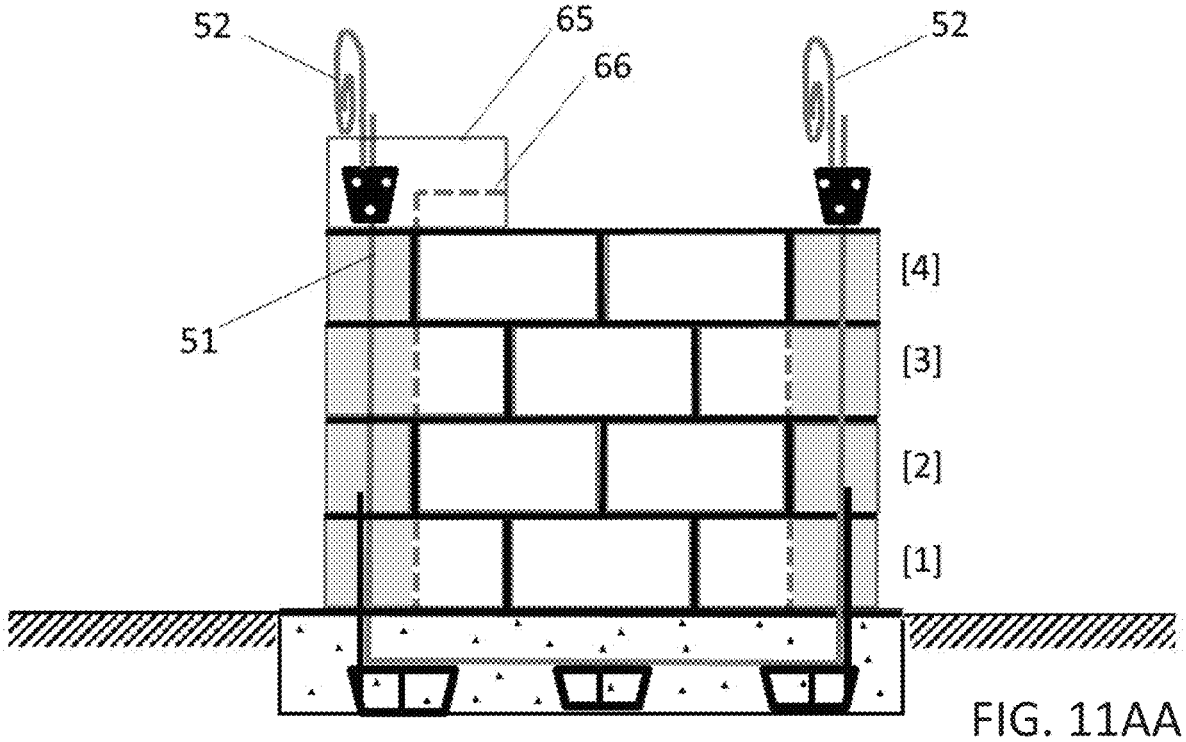
Figure 11A:
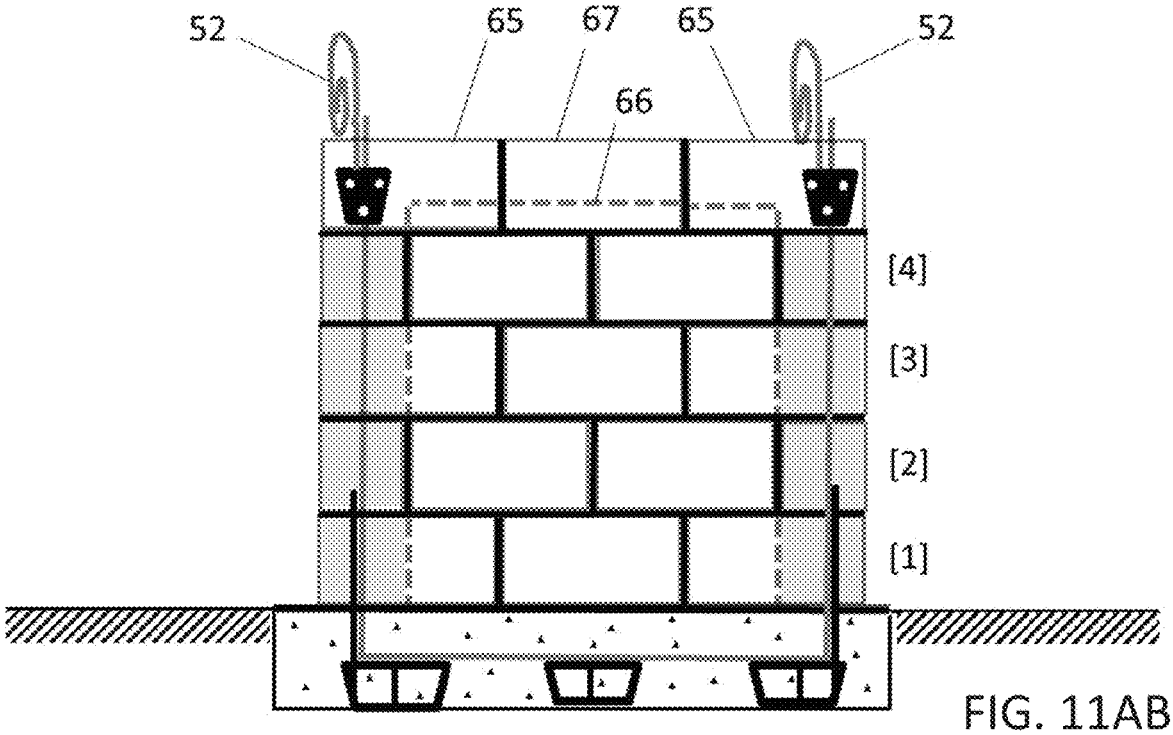
Figure 11A:
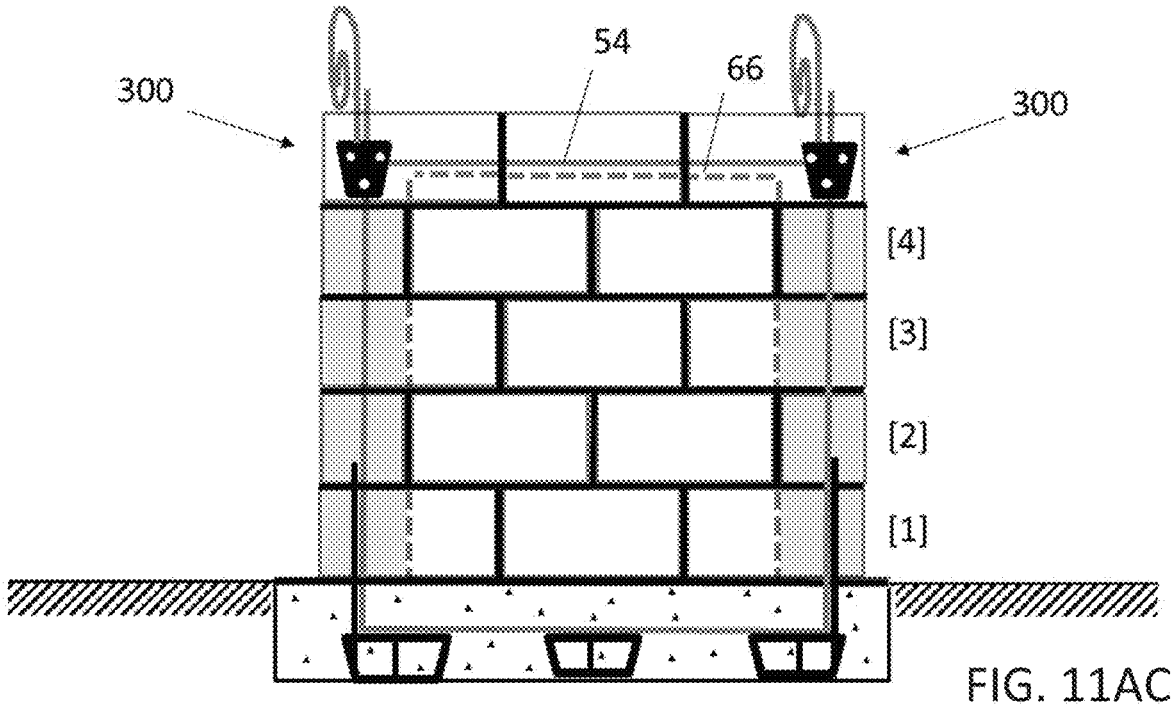
Figure 11A:
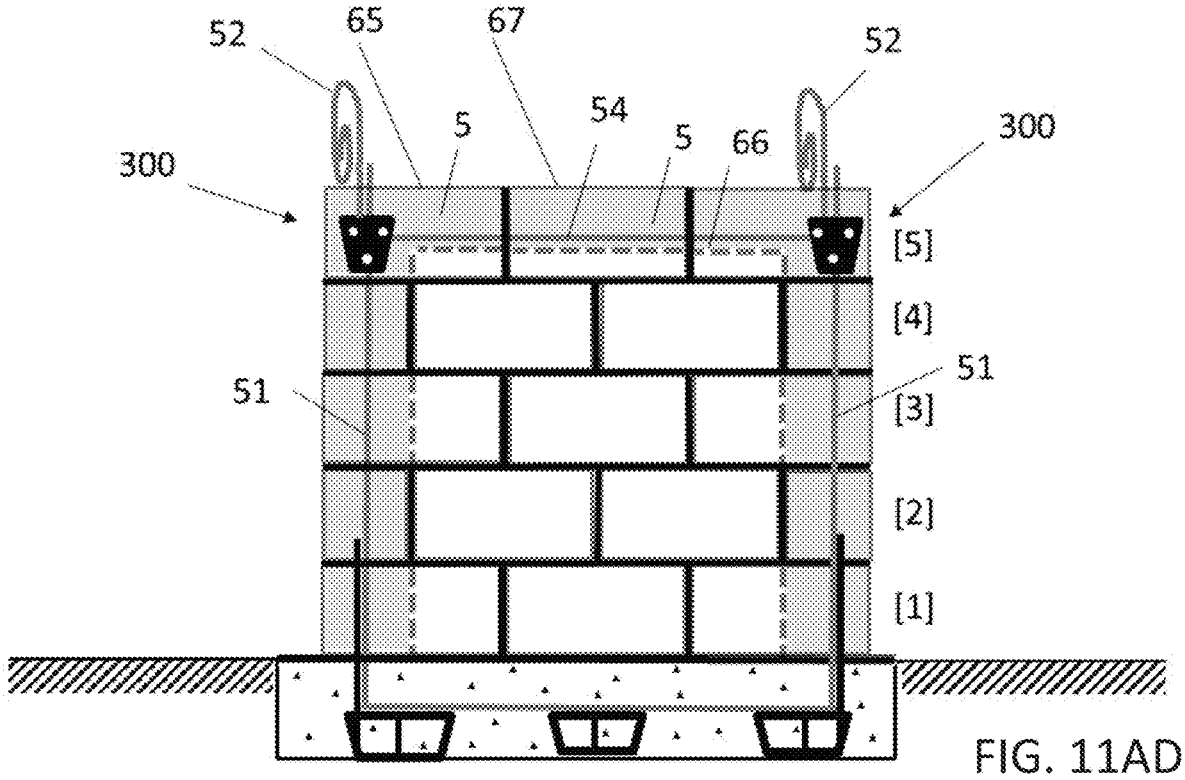
Figure 11A:
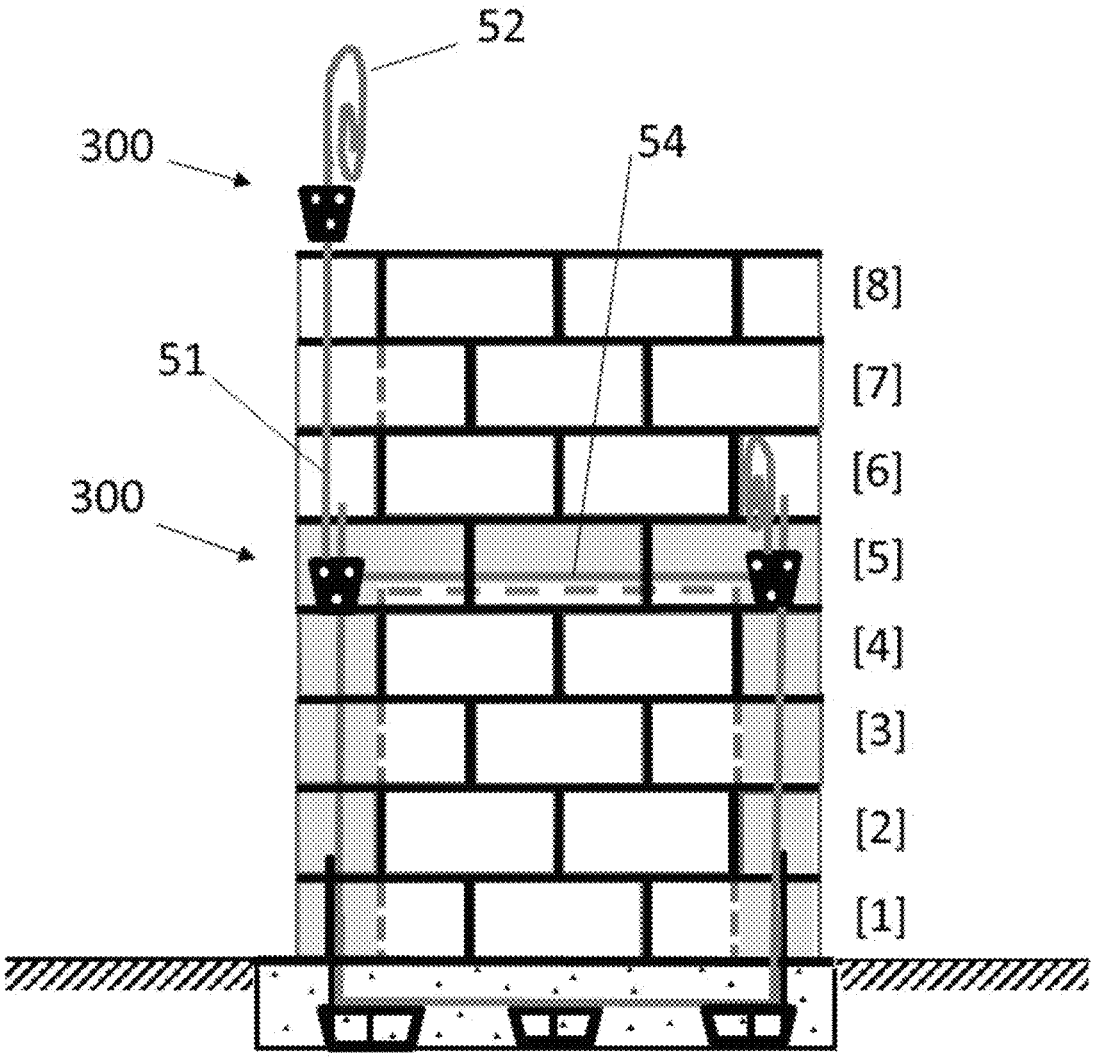
Figure 11A:
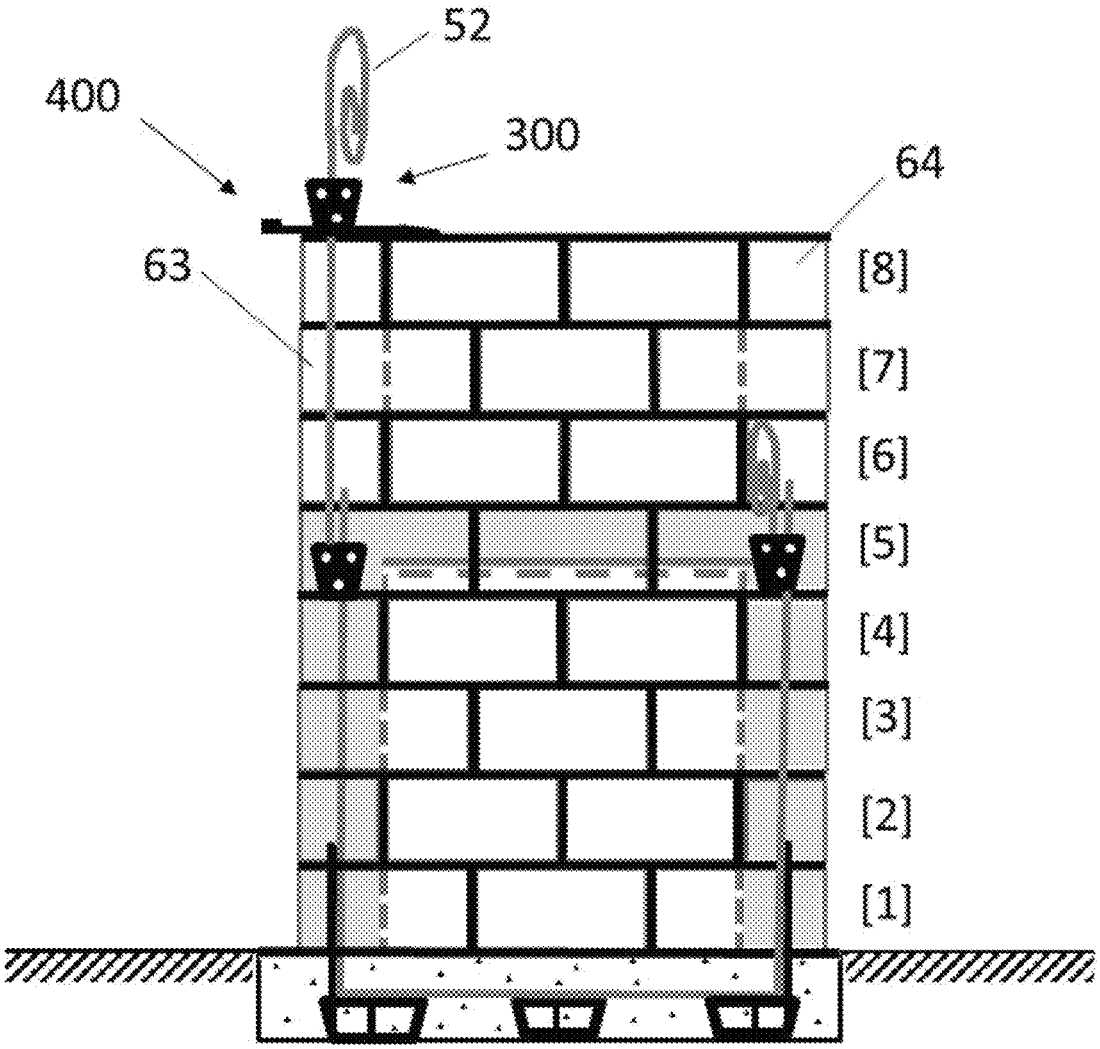
Figure 11A:
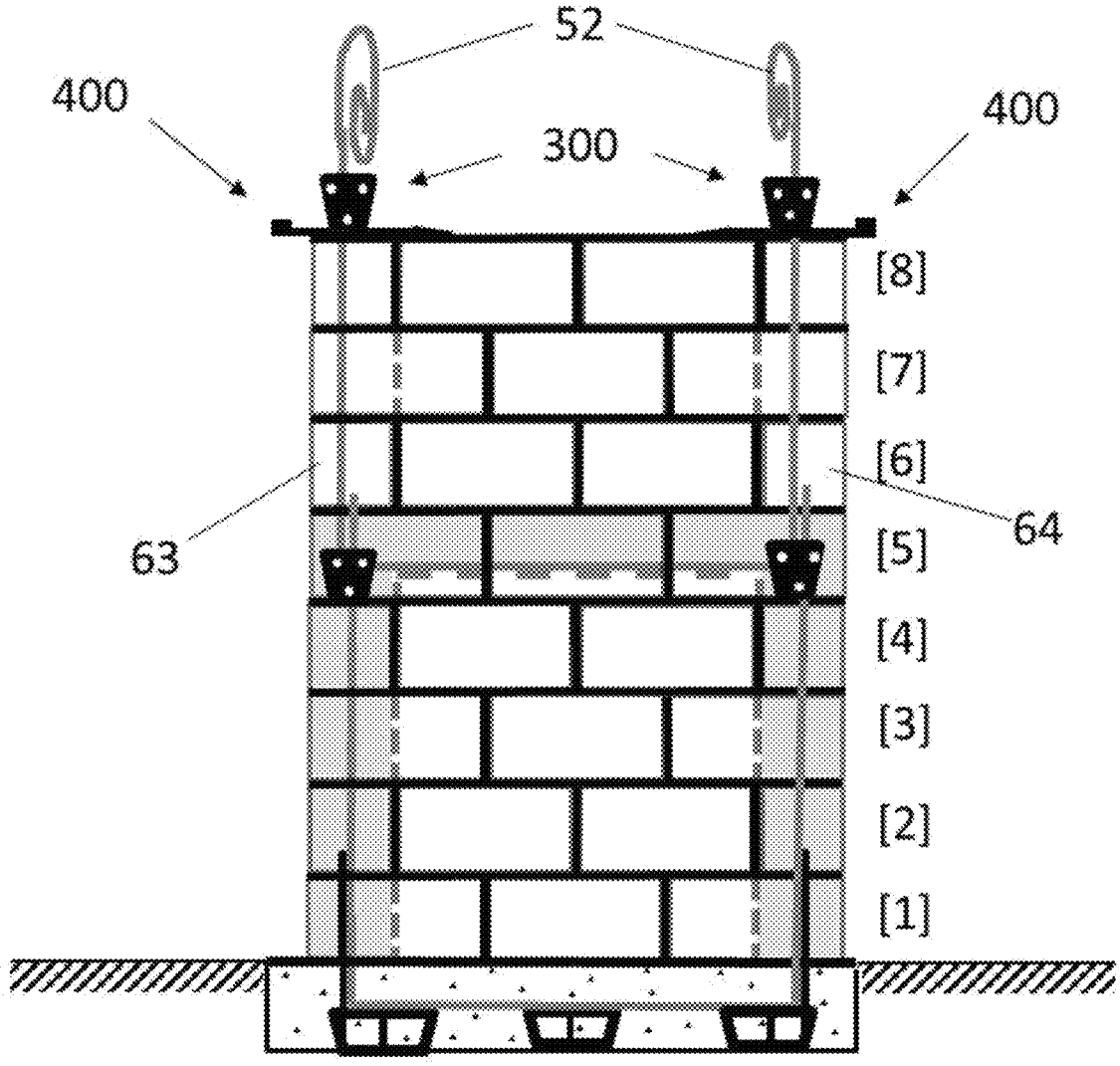
Figure 11A:
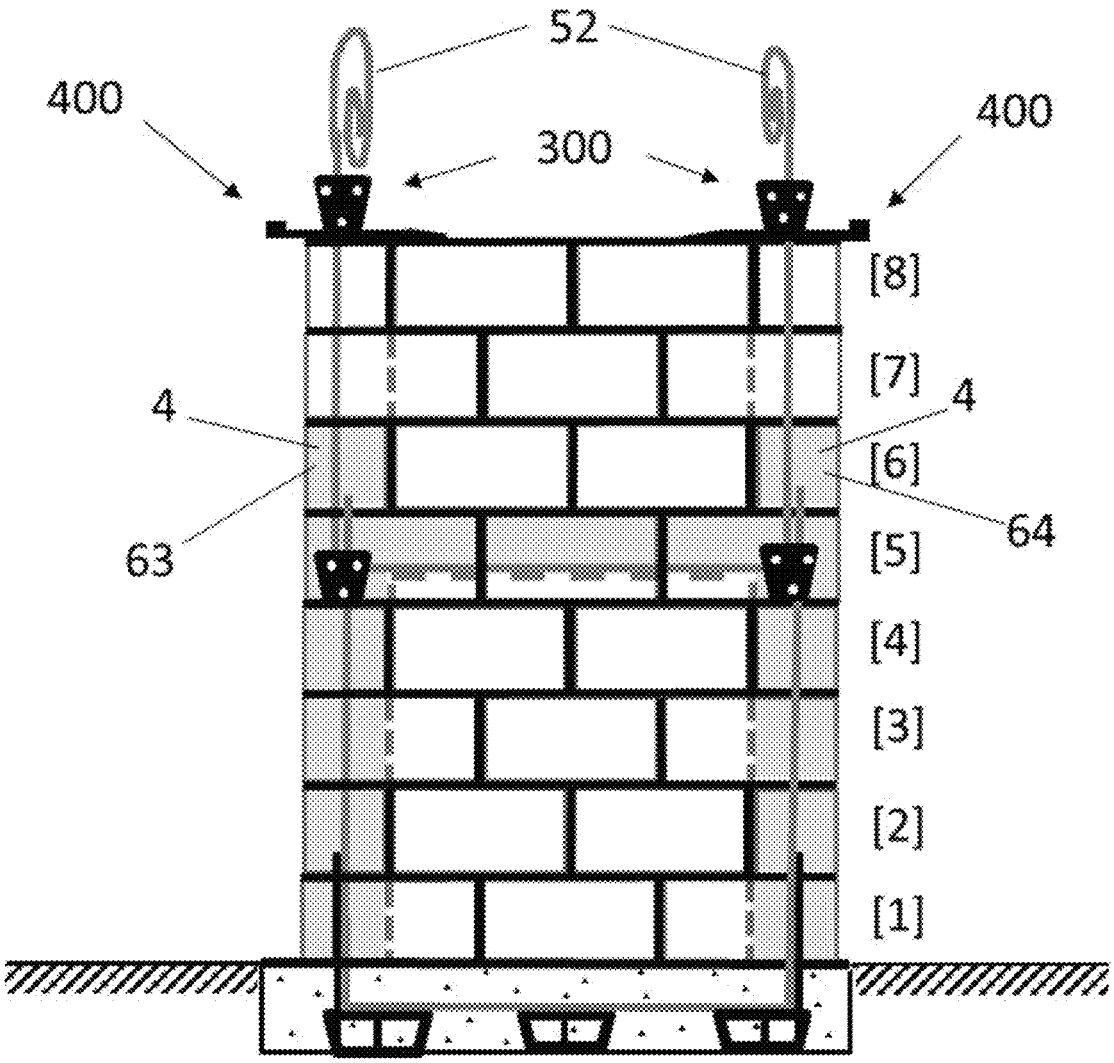
Figure 11A:
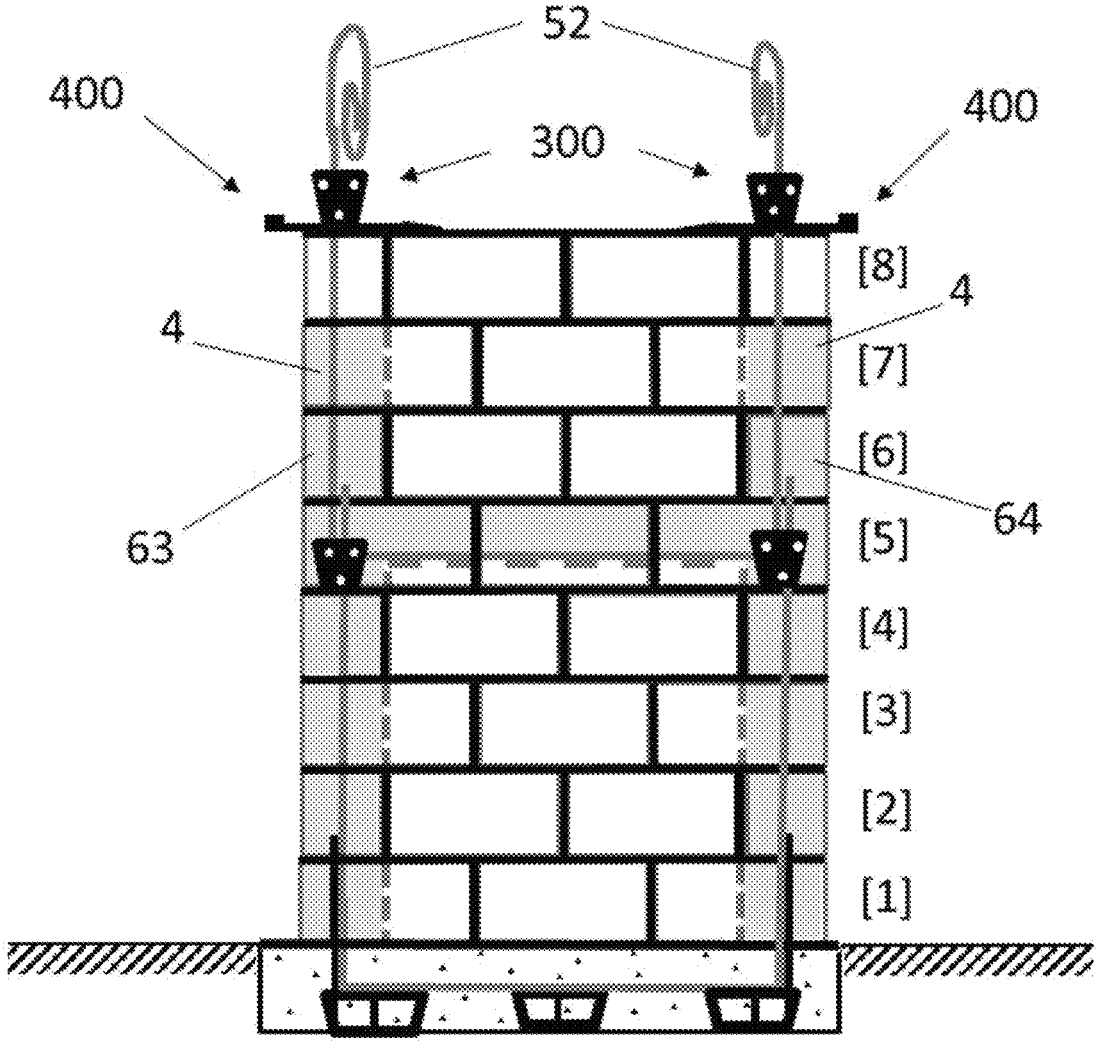
Figure 11A:
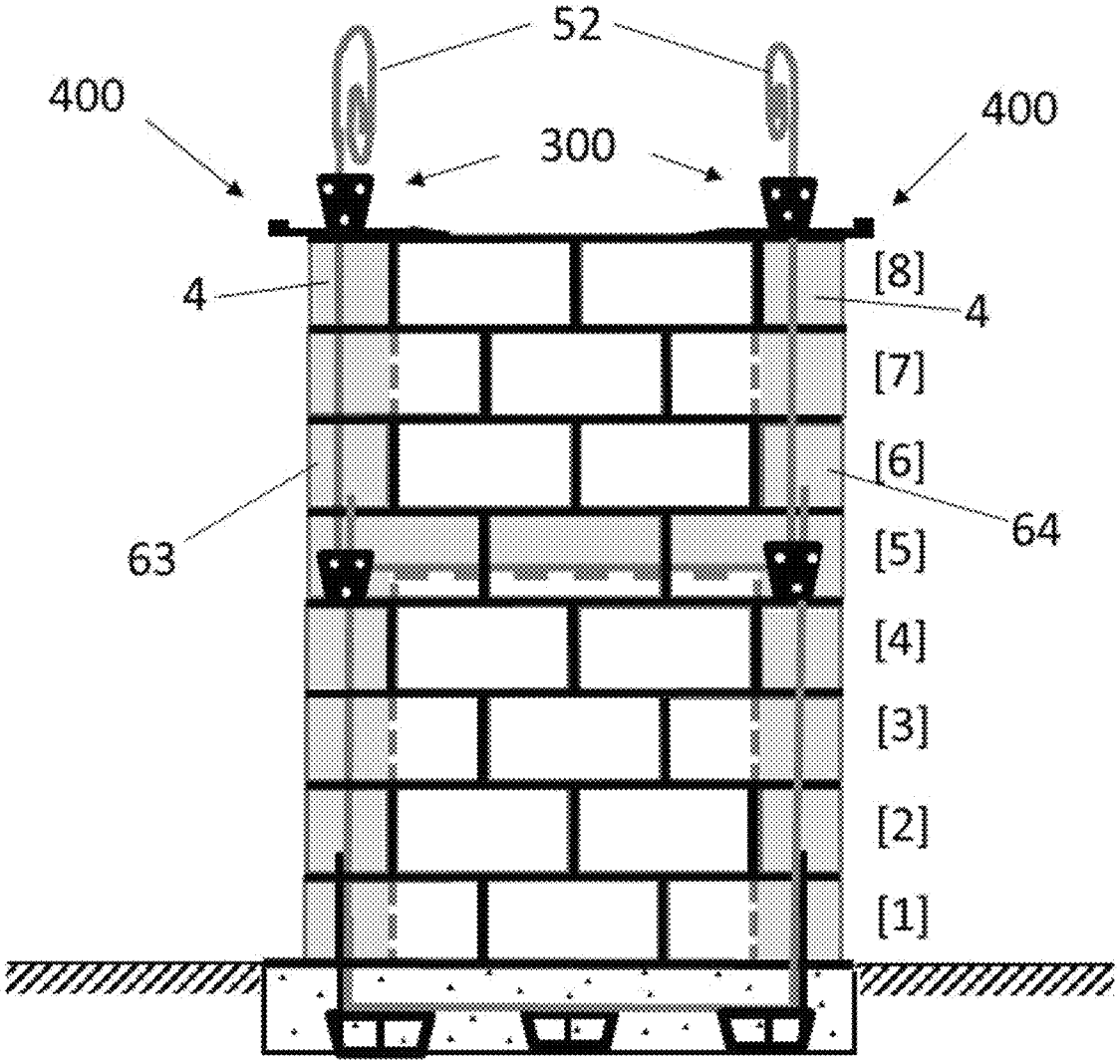
Figure 11A:
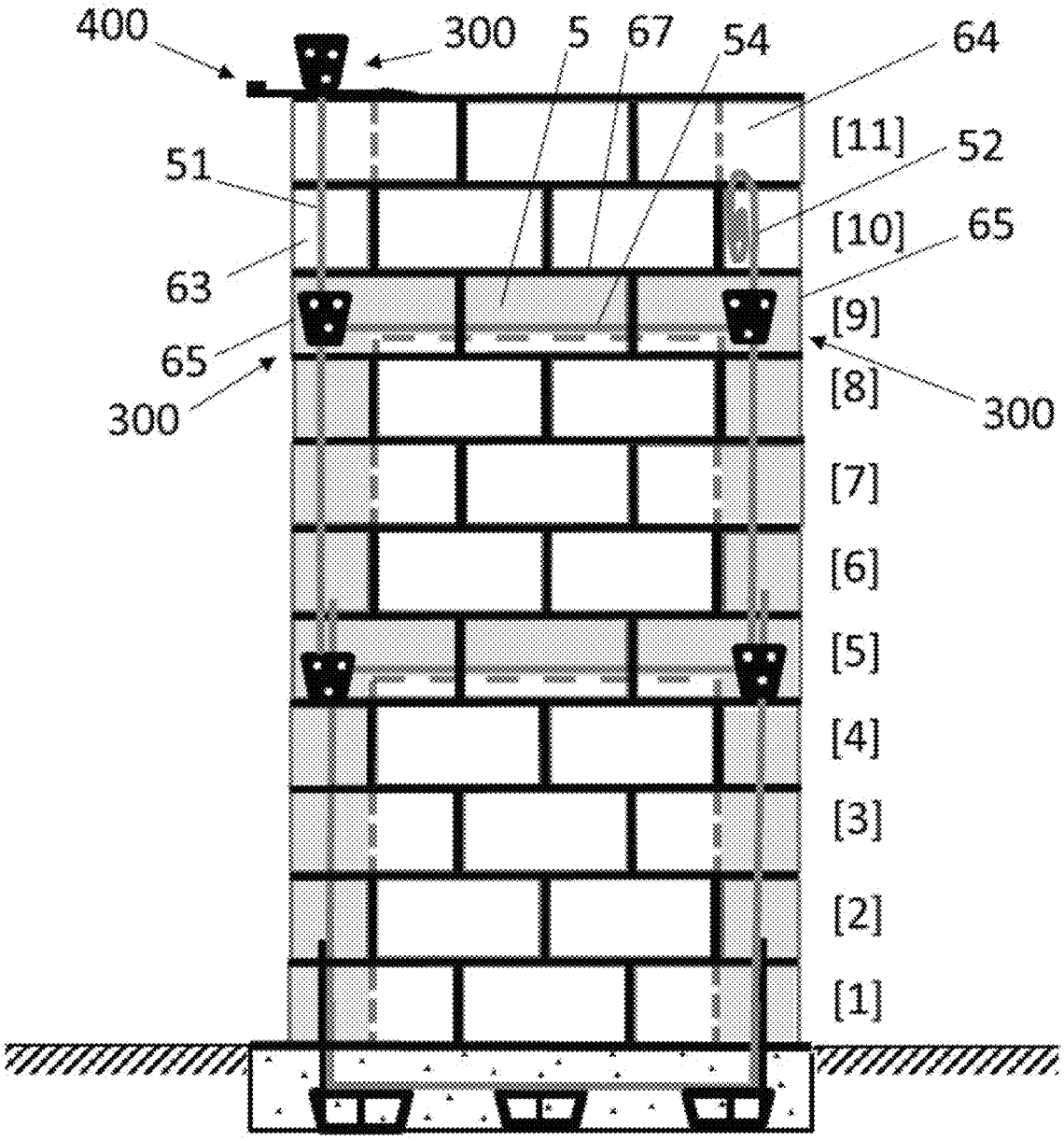
Figure 11A:
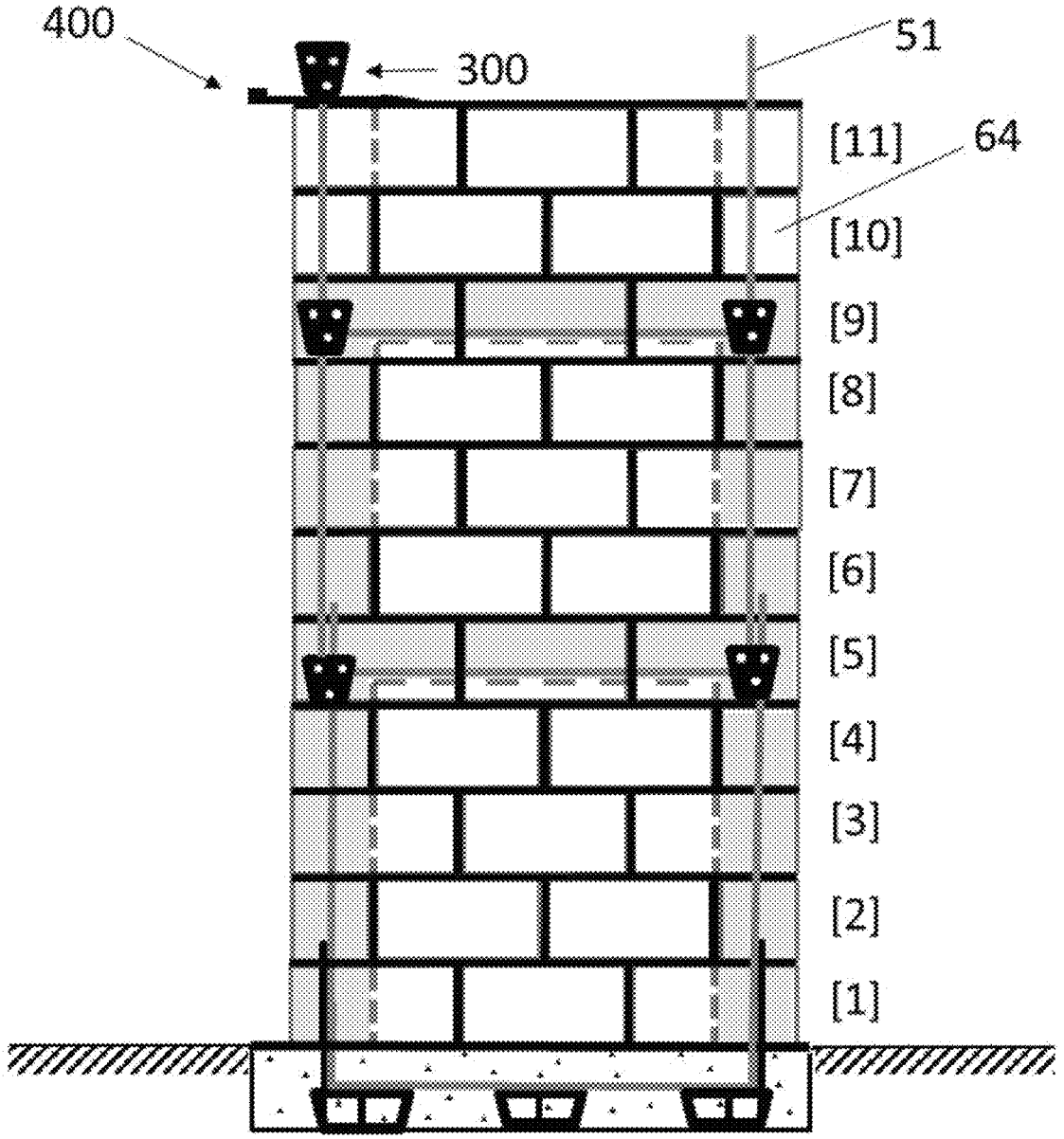
Figure 11A:
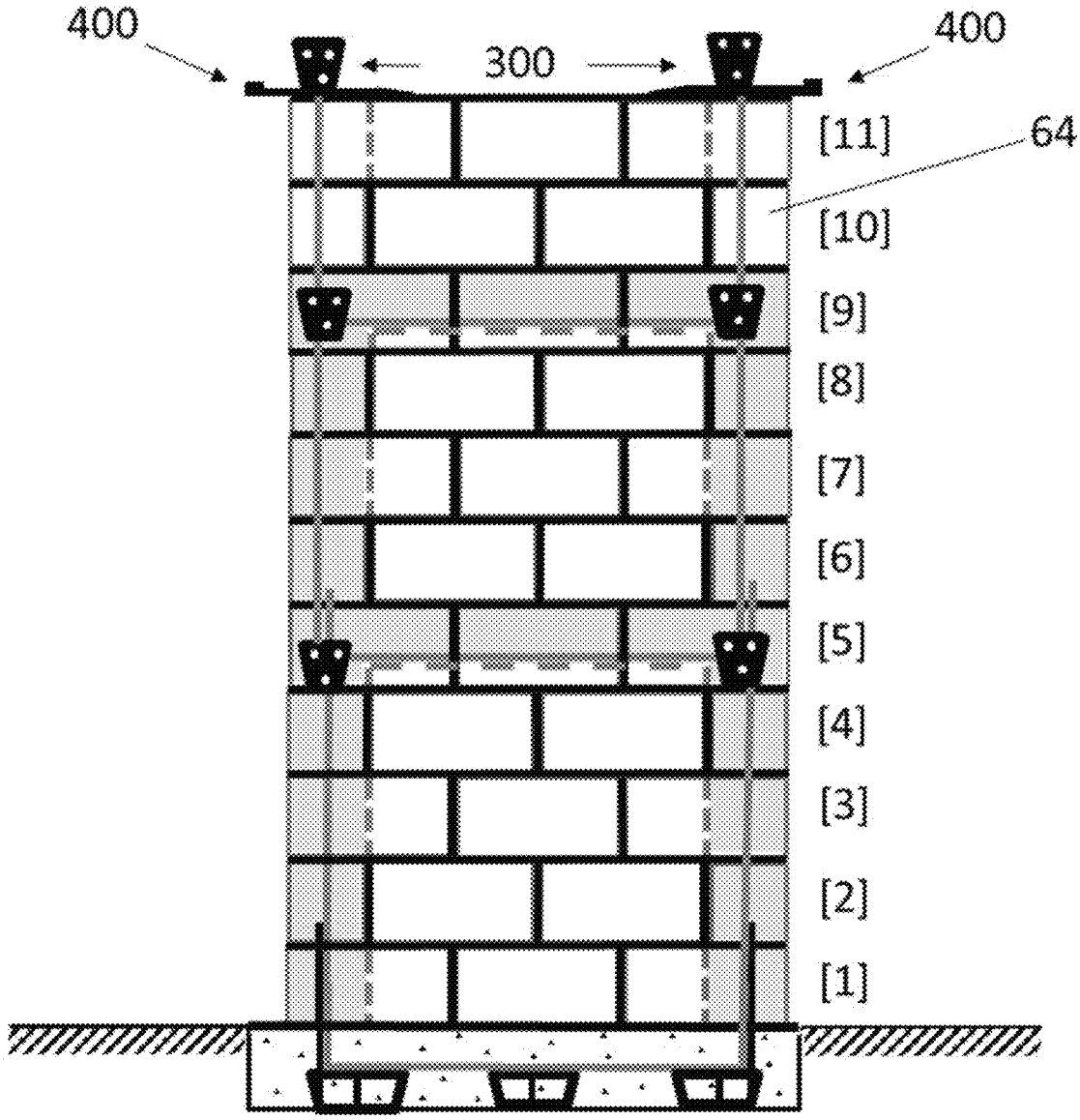
Figure 11A:
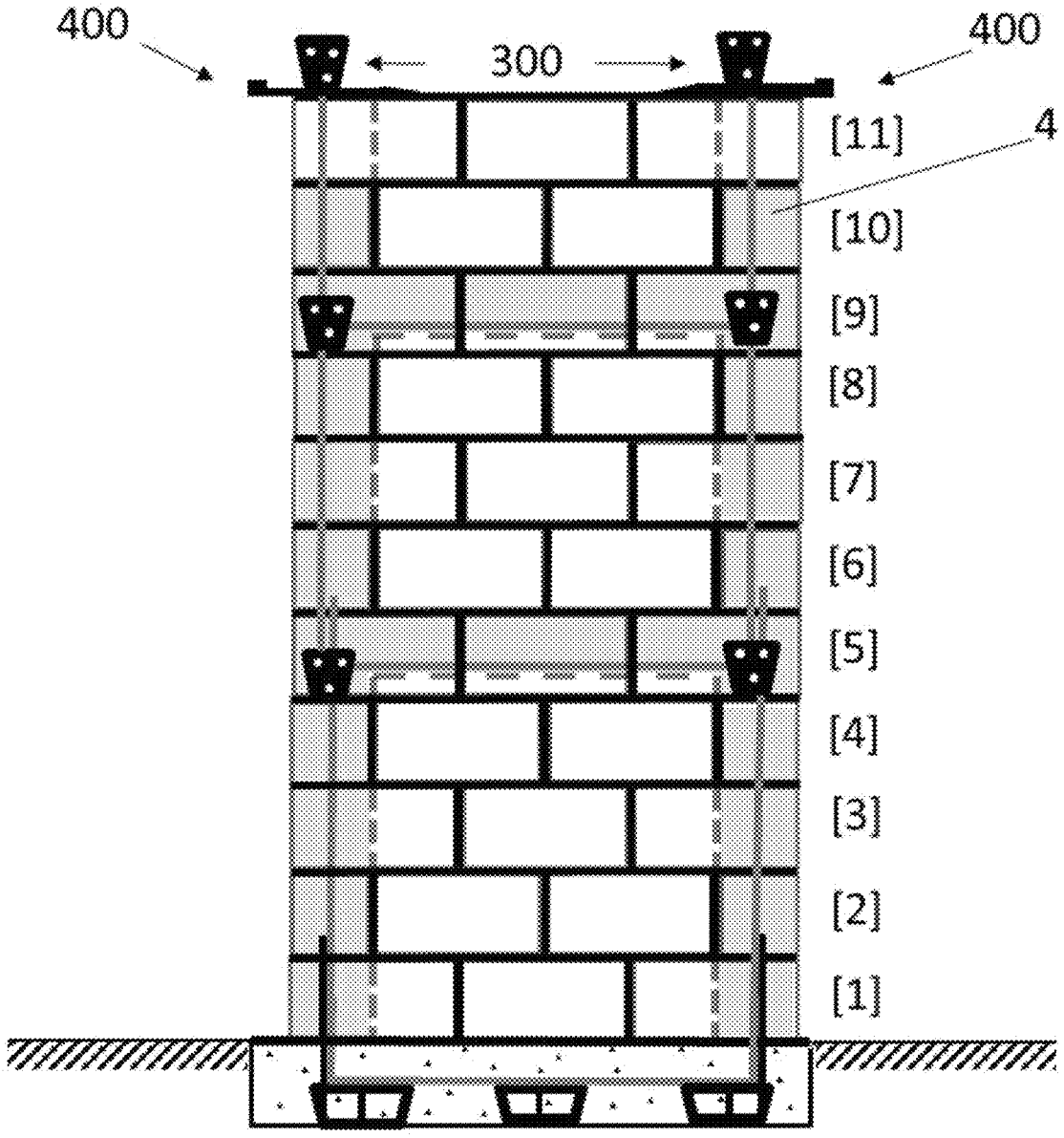
Figure 11A:
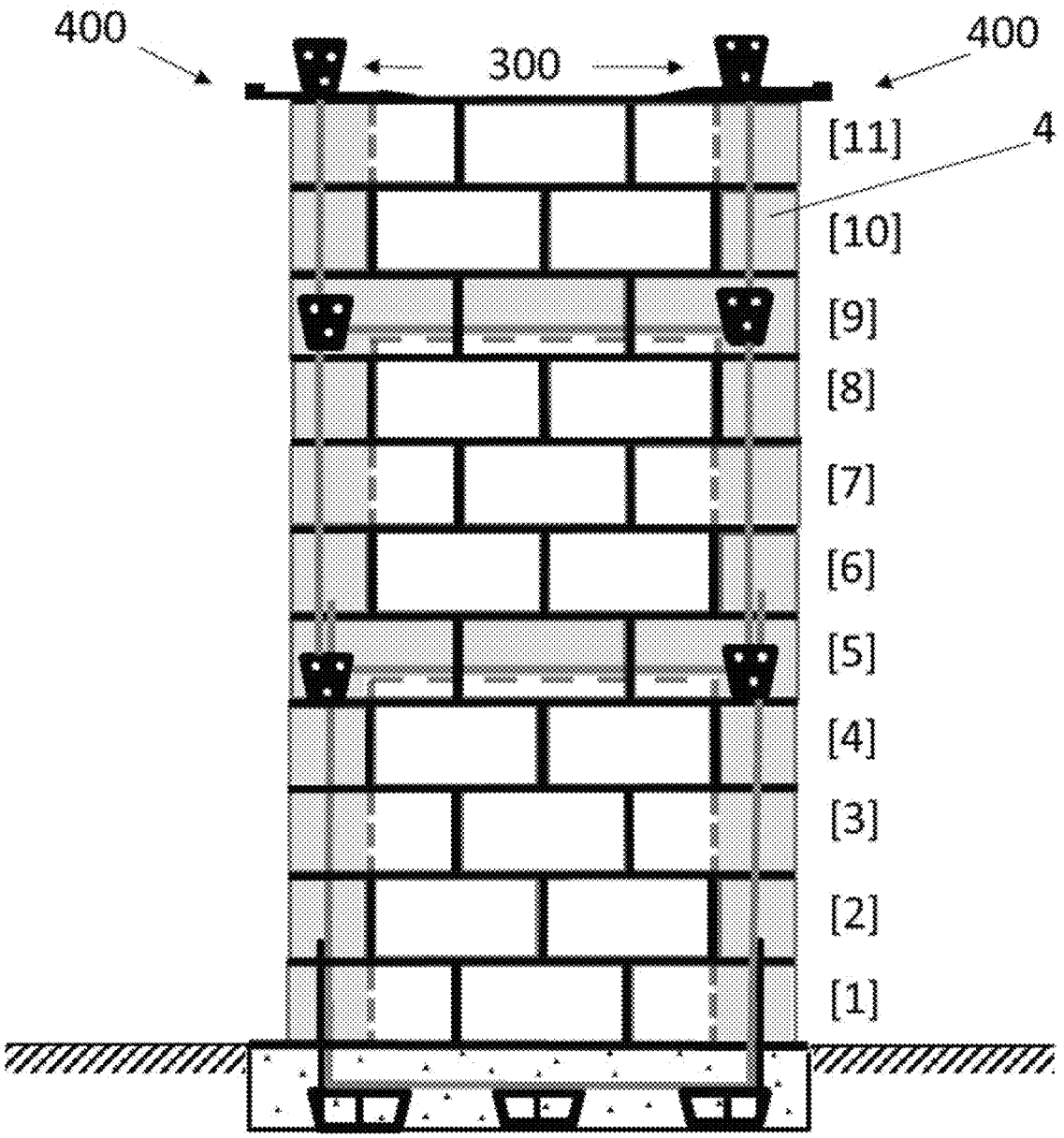
Figure 11A:
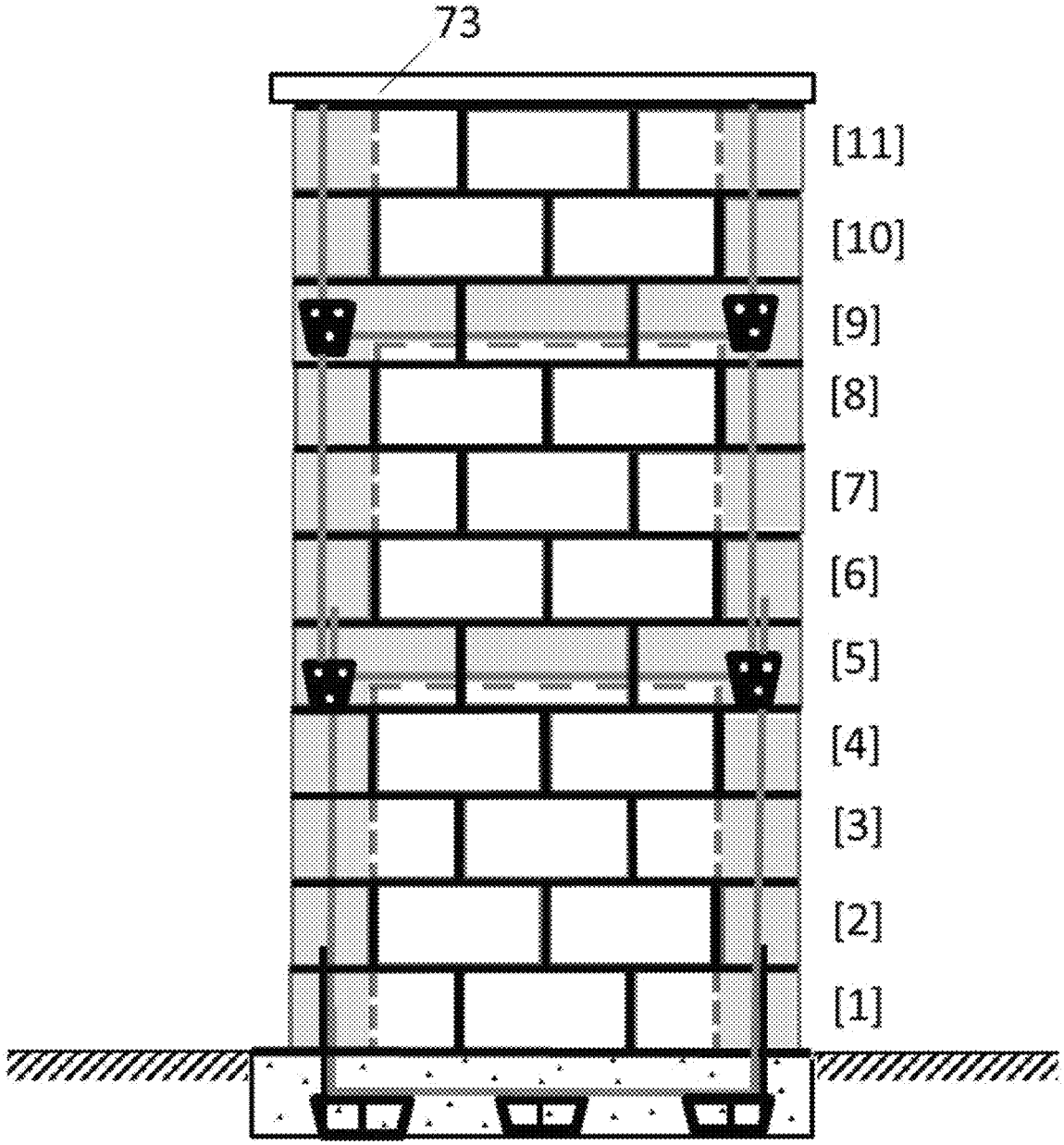

The methods continue with the addition of a mortar layer 70 in FIG. 11Z and the start of the fifth course [5] of the wall units in FIG. 11AA. In the example shown, the fifth course [5] is started on the leftmost wall unit in FIG. 11AA with a full-size bond beam 65 or equivalent, modified to accept vertical reinforcement, as shown by the base of the block 66. In FIG. 11AB, a full-size bond beam without modification 67 is used for the center block. A full-size bond beam 65, modified to accept vertical reinforcement, is used for the rightmost wall unit as shown in FIG. 11AB.

In FIG. 11AC a wire rope 54 is extended horizontally in the bond beam and is attached to the connectors 300, using the U-bolts 309 on the outside of the back plates 301 of the connectors 300, as shown in FIG. 7C.

FIG. AD shows the addition of grout 5 in the horizontal hollow cores of the bond beams 65 and 67 for the completion of wall course five [5]. In the example shown in FIG. 11AD, the wire rope connectors 300 join wire ropes 51, 54, and the lower segment of the coiled wire rope 52. With the addition of grout 5, the wire rope connectors 300 shown in FIG. 11AD also serve as anchors once wire ropes 52 are subsequently pulled straight and upward through the remaining hollow cores of the wall units in subsequent steps.

FIG. 11AE shows an advance to the completion of courses six through eight [6-8] of the wall units where a second wire rope connector 300 is added to the wire rope 51 after it is pulled straight and upward by hand through the hollow cores. FIG. 11AF shows the insertion of a wire-rope pin 400 beneath the wire rope connector 300 for applying a small amount of tension to the wire rope 51 for straightening it before the addition of grout and with the excess wire rope coiled 52.

FIG. 11AG shows a second wire rope connector 300 added to the right side of the wall and the wire rope 51 after it is pulled straight and upward by hand through the hollow cores. The insertion of a wire-rope pin 400 is shown beneath the wire rope connector 300 for applying a small amount of tension to the wire rope 51 for straightening before the addition of grout and with the excess wire rope coiled 52.

Grout 4 is used to fill the cores in the six, seventh, and eight courses [6-8] as shown in FIGS. 11AH, 11AI, and 11AJ, respectively, on both the left and right sides of the wall.

FIG. 11AK shows an advance to the completion of courses nine through eleven [9-11] of the wall units, with course eleven [11] designed in this example as the final course. Course nine [9] uses a bond beam configuration like that used in course five [5]; however, in this example, the wire rope connector 300 only joins wire ropes 51 and 54. A temporary wire rope connector 300 and wire rope pin 400 apply a small amount of tension to the wire rope 51 for straightening before the addition of grout in the left cores 63.

FIG. 11AL shows the wire rope on the right side of the wall in the hollow cores 64 pulled straight 51 and upward by hand through courses ten and eleven [10 and 11]. A temporary wire rope connector 300 and wire rope pin 400 are shown in FIG. 11AM applying a small amount of tension to the wire rope 51 for straightening before the addition of grout. Grout 4 is used to fill the cores in the tenth course [10] and the eleventh course [11] as shown in FIGS. 11AN and 11AO, respectively, on the left and right sides of the wall. The temporary wire rope pin 400 and the wire rope connector 300 are removed in FIG. 11AP and a sill plate 73 is added.

FIG. 12A through 12F shows the use of a hand operated wire rope straightener 500, which will sometimes be referred to herein as a tensioner tool, according to at least one embodiment, that may be used in special circumstances. In most situations, as shown in the example application in FIG. 11A through FIG. 11AP, the wire rope can be uncoiled and pulled straight and upward through the hollow cores without the need of the wire rope straightener, relying instead on the wire rope connector 300 and wire rope pin 400 to apply a small amount of tension to the wire rope before the addition of grout in the hollow cores. However, the wire rope straightener 500 may be used when the wire rope is obstructed (for example by a web, mortar, grout, or limited access areas within the cores) and the wire rope is unable to be reasonably straightened by hand and/or by using the wire rope connector 300 coupled with the use of the wire rope pin 400 when wedged beneath the wire rope connector 300 and the wall unit.

Figure 12A:
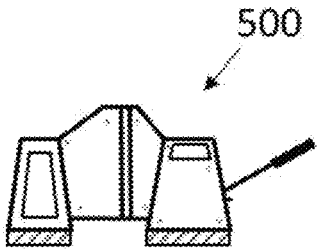
FIGS. 12A through 12F provides side elevation and overhead views of a hand operated device that may be used under some circumstances to straighten wire rope, as shown by examples, and referred to in the present disclosure as a wire rope straightener, which will sometimes be referred to herein as a tensioner tool, according to at least one embodiment.
Figure 12B:
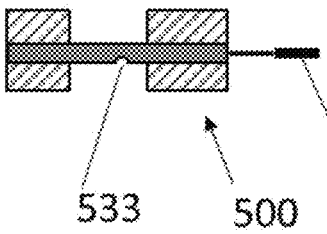

FIGS. 12A and 12B show a side elevation and overhead view of a hand operated wire rope straightener, respectfully. Example applications of the wire rope straightener are shown in FIG. 12C through FIG. 12G, and the mechanical details of the wire rope straightener are described in association with FIG. 13 through FIG. 15, according to at least one embodiment.

Figure 12G:
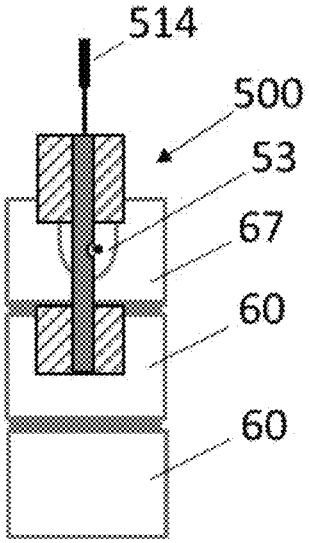
Figure 12C:
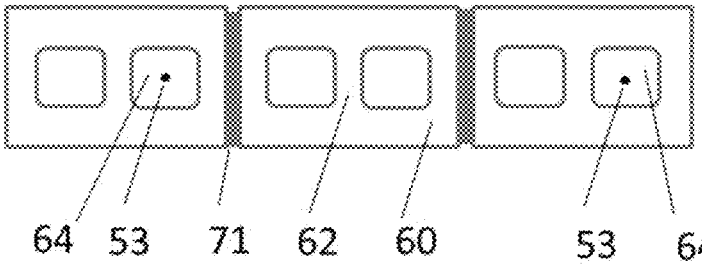
Figure 12D:
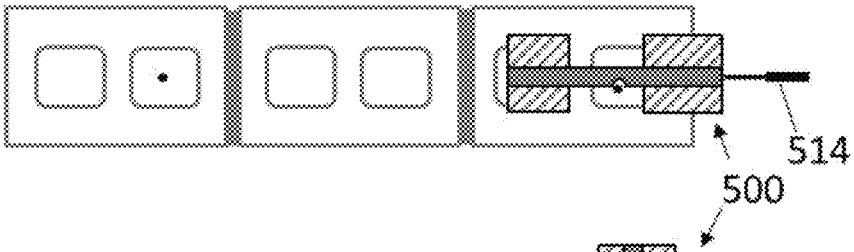
Figure 12E:
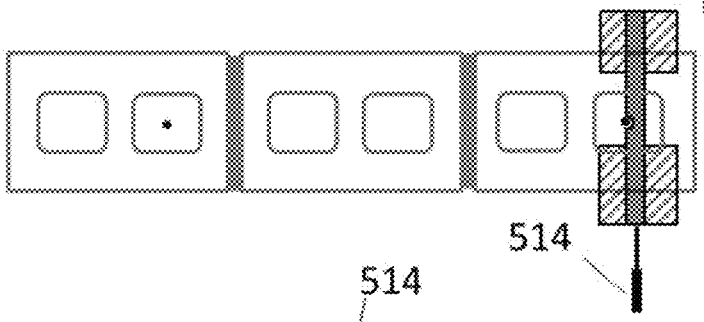
Figure 12F:
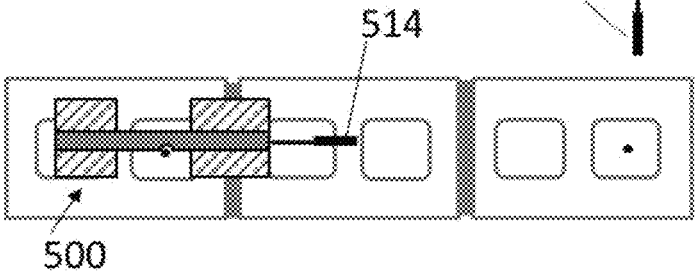

FIG. 12B shows a slot 533 for the wire rope 53. FIG. 12C is an overhead view of three hollow core wall units 60, each with two cores separated by a web 62, mortared together vertically 71 to form a wall segment. Cross sections of wire rope 53 are shown in two of the right vertical cores 64. FIG. 12D is an overhead view of the same wall segment of FIG. 12C, showing the wire rope slot 533 of the wire rope straightener 500 around the wire rope 53 with the handle 514 to the right, parallel to the wall segment. FIG. 12E is an overhead view of the same wall segment of FIG. 12C, showing the wire rope slot 533 of the wire rope straightener 500 around the wire rope 53 in the rightmost wall unit with the handle 514 of the wire rope straightener 500 perpendicular to the wall segment. FIG. 12F is an overhead view of the same wall segment of FIG. 12C, showing the wire rope slot 533 of the wire rope straightener 500 around the wire rope 53 in the leftmost wall unit with the handle 514 of the wire rope straightener 500 to the right, parallel to the wall segment. FIG. 12G is a sectional view of a wall segment, where the top course is a bond beam 67 and the lower two courses are hollow core wall units 60. The wire rope slot 533 of the wire rope straightener 500 is around the wire rope 53 in the bond beam with the handle 514 of the wire rope straightener 500 upright and parallel to the wall segment.

Figure 13:
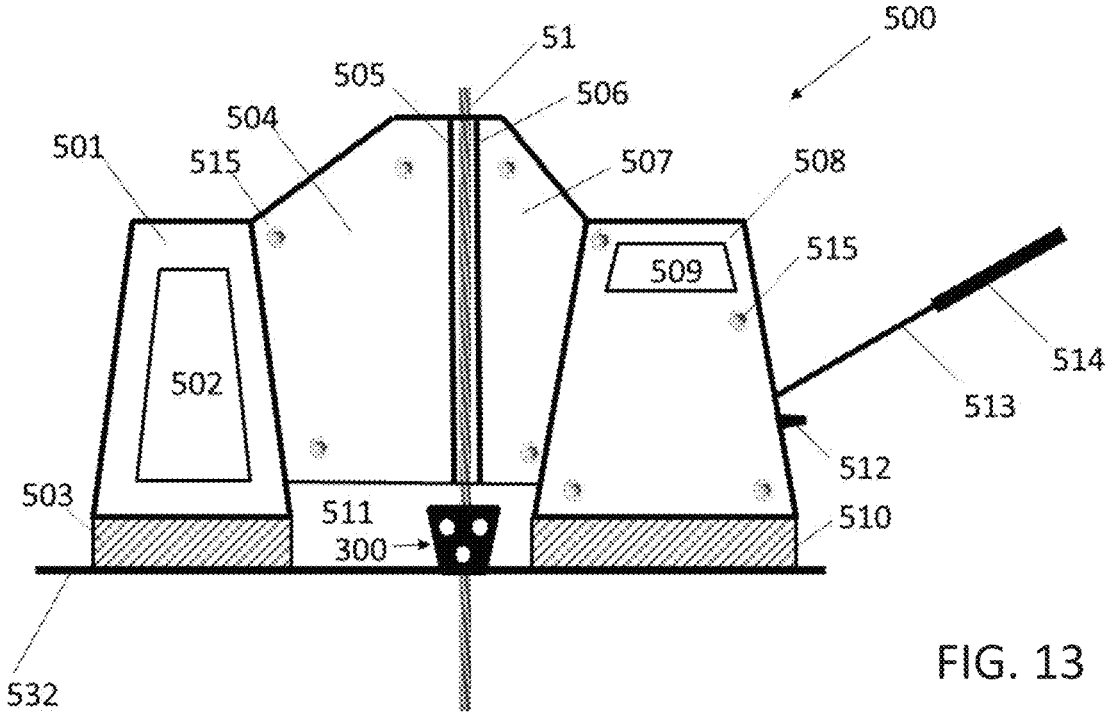
FIG. 13 is a side elevation view of a wire rope straightener, according to at least one embodiment.

FIG. 13 is a side elevation view showing the details of a hand operated wire rope straightener 500, according to at least one embodiment. A left support member 501, with an open area 502, is connected to a base 503 that extends wider than the than the wire rope straightener 500, as shown in the overhead views in FIG. 12. A left center removable panel 504 is held in place with hex bolts 515 and the panel has an open work area 511 beneath it. The left side of a wire rope slot 505 is shown along with a vertical segment of wire rope 51. A right center removable panel 507 is held in place with hex bolts 515 and the panel has an open work area 511 beneath it. The right side of a wire rope slot 505 is shown, and a wire rope connector 300 is shown on the top of the wall unit 532 (the details of the wall unit 532 are not shown in the enlarged views of FIG. 13 through FIG. 17).

FIG. 13 shows a right support member 508, with an open area 509, is connected to a base 510 that extends wider than the than the wire rope straightener 500, as shown in the overhead views in FIG. 12. The right support member 508 has a removable panel held in place with hex bolts 515. A ratchet handle 513 and grip 514 extend from the right side of the right support member 508. A ratchet release lever 512 is below the ratchet handle 513. The open areas 502 and 509 make the wire rope straightener 500 lighter weight and can be used as handles to lift the device and center it over the work area.

Figure 14:
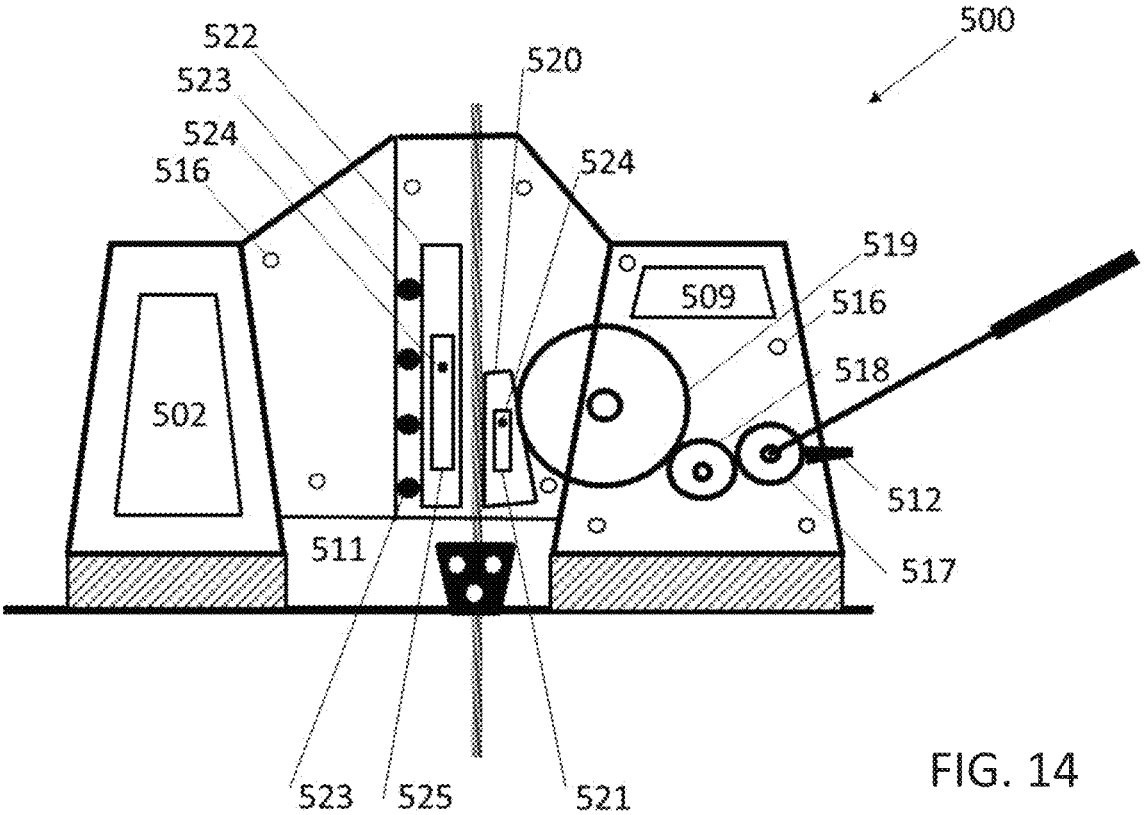
FIG. 14 is a side elevation view of a wire rope straightener, with the panels removed, showing the internal mechanical components, according to at least one embodiment.

FIG. 14 is a side elevation view of a hand operated wire rope straightener 500 with the panels removed, showing the operation of the internal mechanical components, according to at least one embodiment. Threaded hex head bolt holes 516 are shown, along with a ratchet gear 517, small gear 518, and large gear 519 (teeth on the gears are not visible in the side elevation view of FIG. 14). A wedge 520, has teeth on the right (not shown) that interface with the large gear 519. The wedge 520 also has teeth on the left (not shown) to grip the wire rope 51. A slot 521 is on the inside of the wedge 520, and a stop 524 limit the vertical movement of the wedge 520. A rectangular block 522 has teeth on the right side (not shown) to grip the wire rope 51 on the left side, once the wedge 520 moves upward and is forced to shift slightly to the left. A slot 525 on the inside of the rectangular block, and a stop 524 limit the vertical movement of the rectangular block 522. Bearings 523 support the rectangular block and allow its movement vertically.

Figure 15:
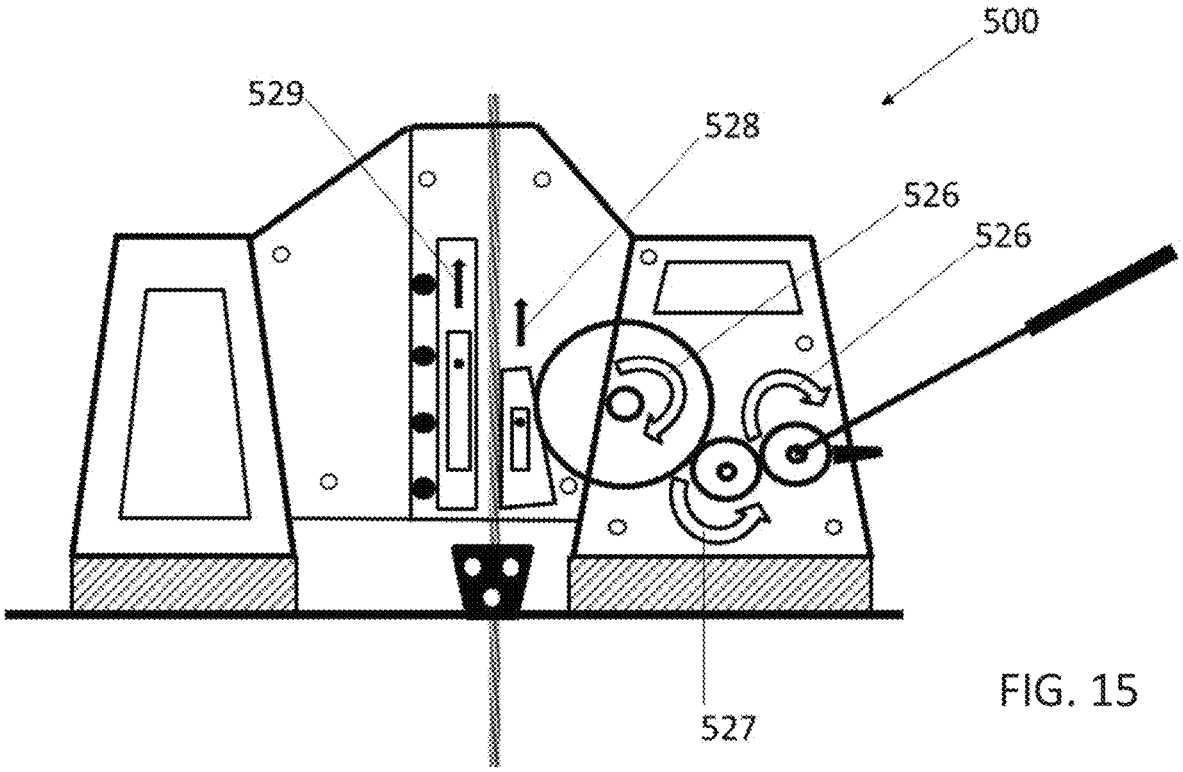
FIG. 15 is a side elevation view of a wire rope straightener, showing the operation of the internal mechanical components, according to at least one embodiment.

FIG. 15 is a side elevation view of a hand operated wire rope straightener 500 with panels removed, showing the rotation of gears 517 and 519 in a clockwise direction 526 and gear 518 in a counterclockwise direction 527. The upward motion of the wedge 520 is represented by arrow 528 and the upward motion of the rectangular block 522 is represented by arrow 529.

Figure 16:
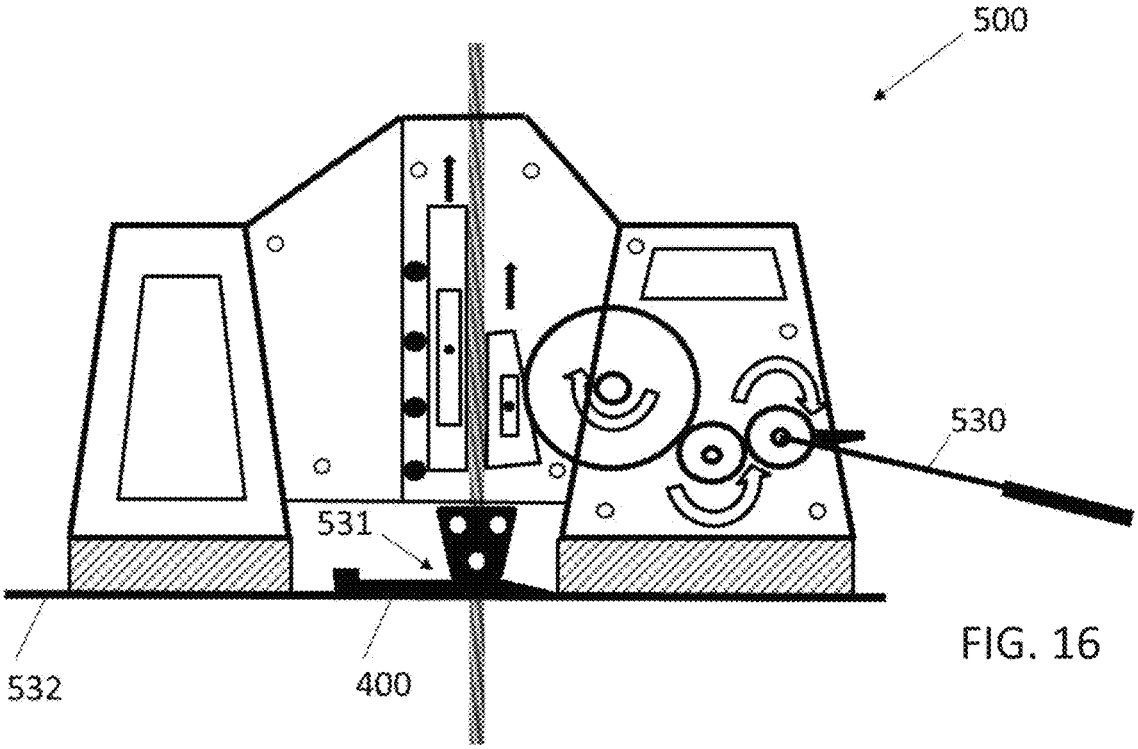
FIG. 16 is a side elevation view of a wire rope straightener showing the operation of the internal mechanical components when the handle is depressed, engaging and straightening the wire rope in the hollow core of the wall unit, and showing the insertion of a wire rope pin beneath the wire rope connector, according to at least one embodiment.

FIG. 16 is a side elevation view of a hand operated wire rope straightener 500 with panels removed, showing the rotation of gears and the upward motion of the wedge 520 and the upward motion of the rectangular block 522 when the handle 530 is depressed. In operation, the wire rope and connector are lifted creating a space 531 above the top of the wall unit 532. FIG. 16 also shows the insertion of a wire rope pin 400 beneath the wire rope connector once the connector has been lifted with the wire rope. Once the wire rope pin 400 is securely in place, the wire rope straightener can be removed.

Figure 17A:
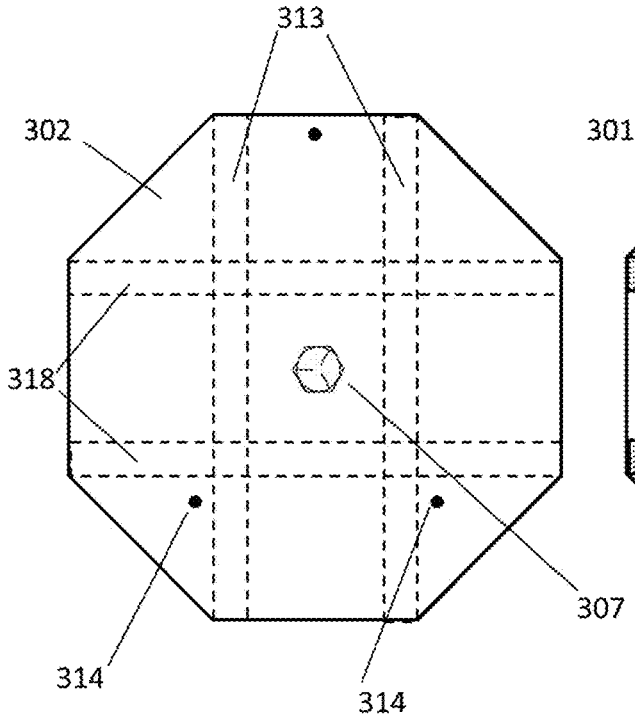
FIG. 17A is an overhead view of a simplified embodiment of a wire rope connector showing the top plate.

FIG. 17A is an overhead view of a simplified embodiment of a wire rope connector 300 relative to that shown in FIG. 7 that can be used to connect multiple wire ropes together from different directions and at opposing angles with torquing of a single bolt head 307. The wire rope connector 300 can also serve as an anchor when secured in grout or concrete. The inside of the top plate 302 shows traces of parallel ridged channels 313 on the inside of the top plate that are at an opposing angle to the traces of parallel ridged channels 318. In this simplified embodiment a single bolt head 307 is shown on the outside of the top plate 302. Offset alignment pins 314 are secured through the top plate 302.

Figure 17B:
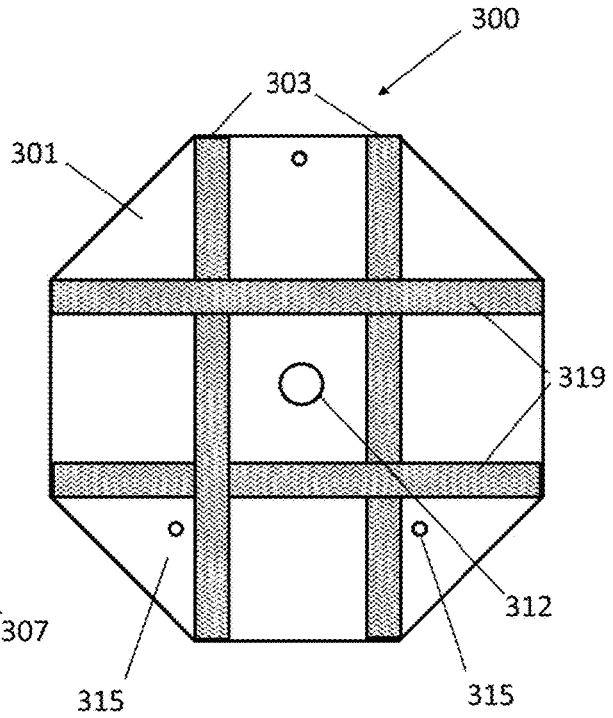
FIG. 17B is an overhead view of a simplified embodiment of a wire rope connector showing the bottom plate.

FIG. 17B is an overhead view of a simplified embodiment of a wire rope connector 300 showing the inside of the bottom plate 301 with parallel ridged channels 303 on the inside of the bottom plate and parallel ridged channels 319 that are at an opposing angle to the parallel ridged channels 303. In this simplified embodiment a single threaded bolt hole 312 is shown on the bottom plate 301. Offset alignment pin holes 315 extend through the bottom plate 301 such that the top 302 and bottom 301 plates, if separated, can only be reassembled in one manner such that the parallel ridged channels 303 and parallel ridged channels 319 at an opposing angle on the inside of the bottom plate align with the ridge channels on the inside of the top plate.

Figure 18A:
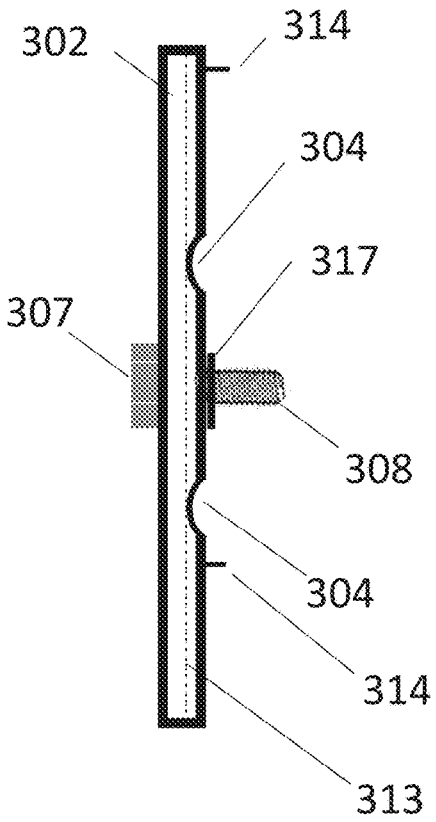
FIG. 18A is a side elevation view of FIG. 17A showing the top plate, in open position.

FIG. 18A is a side elevation view of FIG. 17A showing the top plate 302, in open position and disconnected from the bottom plate 301. A threaded bolt retainer 317 or equivalent prevents the bolt head 307 with the threaded length of the bolt from separating from the top plate 302. Offset alignment pins 314 extend through the top plate 302. Parallel ridged channels 304 are shown on the inside of the top plate.

Figure 18B:
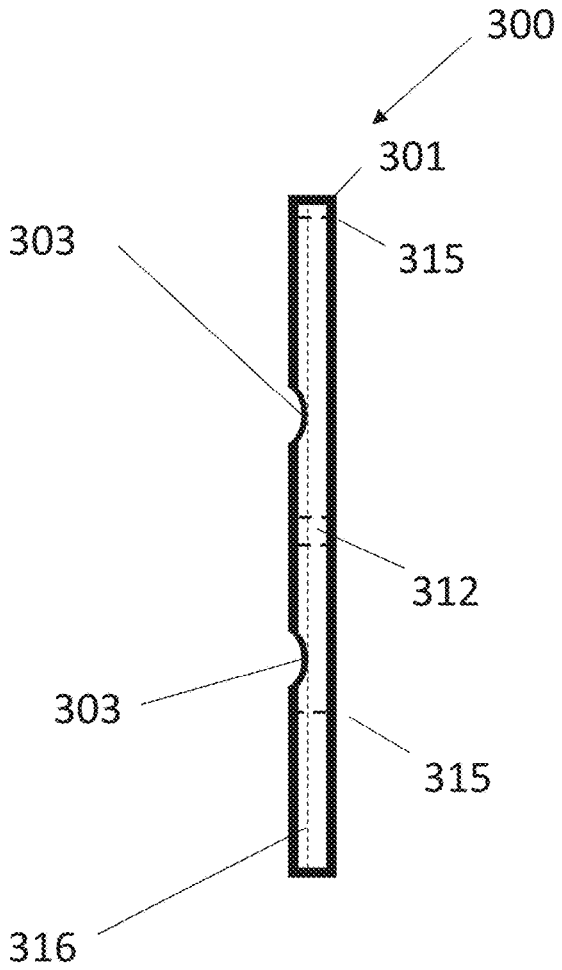
FIG. 18B is a side elevation view of FIG. 17B showing the bottom plate, in open position.

FIG. 18B is a side elevation view of FIG. 17B showing the bottom plate 301, in open position, and disconnected from the top plate 302. A threaded bolt hole 312 aligns with the threaded length of the bolt 308 from the top plate 302 in FIG. 18A. Offset alignment pin holes 315 extend through the bottom plate 301, such that if the upper plate 302 is separated from the bottom plate 301 they can only be reassembled in one manner such that the parallel ridged channels 304 on the inside of the top plate align with those on the inside 303 of the bottom plate. The traces of other parallel ridge channels 313 on the inside of the top plate 302 align with the traces of parallel ridge channels 316 on the inside of the bottom plate 301.

Figures 19A, 19B, 19C:
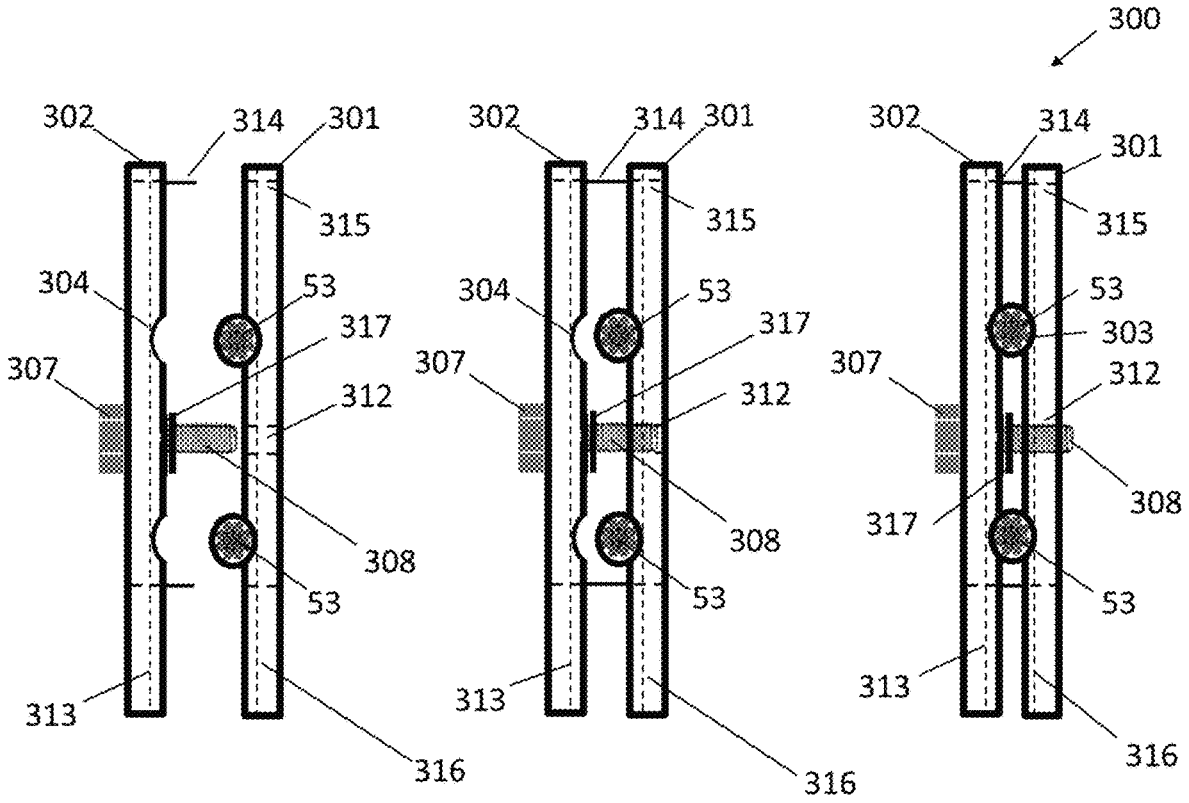
FIG. 19A is a side elevation view of a simplified embodiment of a wire rope connector showing the top and bottom plates in an open position receiving horizontal and parallel strands of wire rope.
FIG. 19B is a side elevation view of a simplified embodiment of a wire rope connector showing the top and bottom plates in a closing position receiving horizontal and parallel strands of wire rope.
FIG. 19C is a side elevation view of a simplified embodiment of a wire rope connector showing the top and bottom plates in a fully closed position compressing horizontal and parallel strands of wire rope.

FIG. 19A is a side elevation view of a simplified embodiment of a wire rope connector 300 showing the top 302 and bottom 301 plates in an open position receiving horizontal and parallel strands of wire rope 53.

FIG. 19B is a side elevation view of a simplified embodiment of a wire rope connector 300 showing the top 302 and bottom 301 plates in a closing position receiving horizontal and parallel strands of wire rope 53.

FIG. 19C is a side elevation view of a simplified embodiment of a wire rope connector 300 showing the top 302 and bottom 301 plates in a fully closed position compressing the horizontal and parallel strands of wire rope 53. The single bolt head 307 is torqued into the threaded hole 312 in the bottom plate 301 such that the parallel and aligned ridged channels in the top plate 304 compress the wire rope sections 53 resting on the parallel and aligned ridged channels in the bottom plate 303 minimizing movement of the wire rope when loads are applied.

Figure 20A:
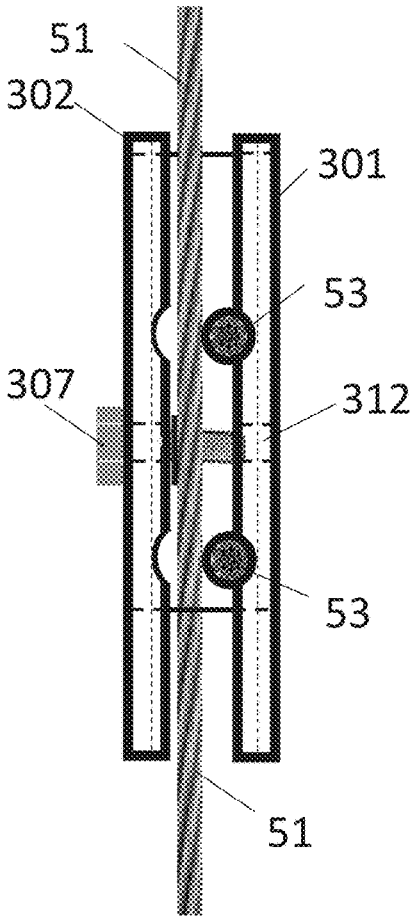
FIG. 20A is a side elevation view of a simplified embodiment of a wire rope connector showing the top and bottom plates in an open position receiving horizontal and parallel strands of wire rope and one or more vertical and parallel strands of wire rope.

FIG. 20A is a side elevation view of a simplified embodiment of a wire rope connector 300 showing the top 302 and bottom 301 plates in an open position receiving horizontal and parallel strands of wire rope 53 and one or more vertical and parallel strands of wire rope 51 that are at an opposing angle.

Figure 20B:
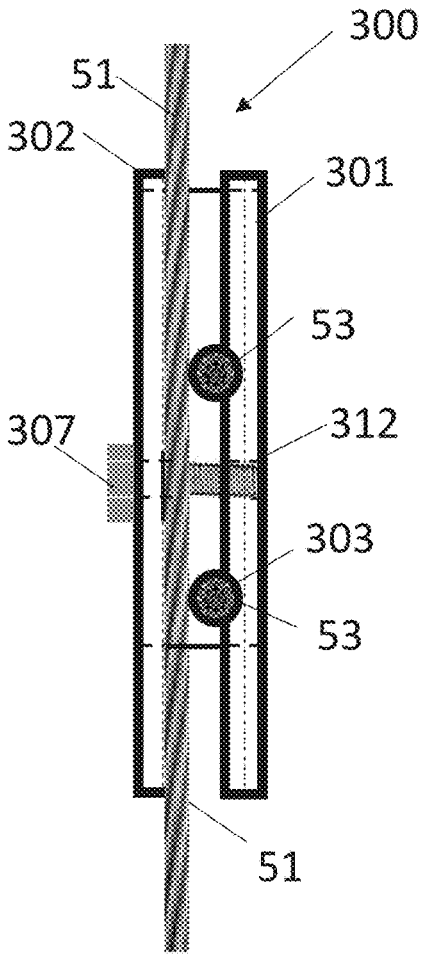
FIG. 20B is a side elevation view of a simplified embodiment of a wire rope connector showing the top and bottom plates in a fully closed position compressing horizontal and parallel strands of wire rope with one or more vertical and parallel strands of wire rope.

FIG. 20B is a side elevation view of a simplified embodiment of a wire rope connector 300 showing the top 302 and bottom 301 plates in a fully closed position compressing horizontal and parallel strands of wire rope 53 with one or more vertical and parallel strands of wire rope 51. The single bolt head 307 is torqued into the threaded hole 312 in the bottom plate 301 to simultaneously compress the one or more vertical and parallel strands of wire rope 51 with the horizontal and parallel strands of wire rope 53 that are at an opposing angle, collectively minimizing movement of the multiple wire ropes when loads are applied.

Particular embodiments and features have been described with reference to the drawings. It is to be understood that these descriptions are not limited to any single embodiment or any particular set of features, and that similar embodiments and features may arise, or modifications and additions may be made without departing from the scope of these descriptions and the spirit of the appended claims.

What is claimed is:

1. A wall structure comprising:

an excavated ground portion for a footing;

a first support device placed in the excavated ground portion and a second support device placed in the excavated ground portion and being spaced-apart from the first support device, each of the support devices comprising a chair with a base, a cross brace, and a horizontally extending support arm for supporting wire rope extending horizontally in the excavated ground portion, wherein the cross brace is coupled to the horizontally extending support arm;

wherein concrete or other reinforcing material is poured into the ground portion after placement of the first and second support devices and the wire rope to form the footing, at least a first row of hollow core wall units constructed in courses on the footing, wherein at least some of the hollow core units define vertical cores;

a wire rope extending from the footing vertically through generally aligned hollow core units and engaged with the first support device;

a wire rope extending vertically through generally aligned hollow core units and engaged with the second support device;

wherein the vertical cores are filled with grout or other material to secure each of the wire ropes relative to the vertical cores.

2. The wall structure of claim 1, wherein the wire rope is configured to be joined with other wire ropes at an elevation above the footing with a wire rope connector.

3. The wall structure of claim 1, wherein the wire rope is configured to be joined with other wire rope by engagement elements, wherein the engagement elements include parallel channels on opposing plates that can be bolted together securing multiple wire ropes in compression that may join the wire rope connector from different directions, vertically and/or horizontally.

4. The wall structure of claim 1, wherein another wire rope is placed horizontally in an open channel of a block positioned at an uppermost surface of the wall and engaged with the wire rope.

* * * * *